United States Patent [19]

Ito

[11] Patent Number: 4,849,790

[45] Date of Patent: Jul. 18, 1989

[54] ADF WITH MULTIPLE DETACHABLE FEED AND DISCHARGE SECTIONS

[75] Inventor: Masazumi Ito, Toyohashi, Japan

[73] Assignee: Minolta Camera Kabushiki Kaisha, Osaka, Japan

[21] Appl. No.: 933,011

[22] Filed: Nov. 20, 1986

[30] Foreign Application Priority Data

| | | | |
|---|---|---|---|
| Nov. 22, 1985 | [JP] | Japan | 60-263328 |
| Nov. 22, 1985 | [JP] | Japan | 60-263329 |
| Nov. 22, 1985 | [JP] | Japan | 60-263330 |
| Nov. 22, 1985 | [JP] | Japan | 60-263331 |

[51] Int. Cl.[4] ..... B65H 3/44; B65H 39/10; G03G 15/00

[52] U.S. Cl. ..... 355/321; 271/9; 271/288; 271/298; 355/313

[58] Field of Search ..... 355/14 SH, 14 C, 14 CU, 355/14 R, 18, 89, 5, 3 SH, 3 R; 271/288–290, 298, 3.1, 9, 291; 364/518

[56] References Cited

U.S. PATENT DOCUMENTS

| | | | |
|---|---|---|---|
| 3,687,540 | 8/1972 | Hashimoto | 355/14 SH |
| 4,273,439 | 6/1981 | Markham et al. | 355/14 R |
| 4,370,052 | 1/1983 | Murakami et al. | 271/288 |
| 4,411,515 | 10/1983 | Kukucka et al. | 355/14 R |
| 4,437,660 | 3/1984 | Tompkins et al. | 271/290 |
| 4,442,505 | 4/1984 | Takano | 355/14 R |
| 4,561,765 | 12/1985 | Masuda | 355/14 SH |
| 4,568,177 | 2/1986 | Sato et al. | 355/14 C |
| 4,569,582 | 2/1986 | Hyloft | 355/3 R |
| 4,647,188 | 3/1987 | Komiya et al. | 355/14 R |

FOREIGN PATENT DOCUMENTS 55-50260 4/1980 Japan .

*Primary Examiner*—A. T. Grimley
*Assistant Examiner*—Edward Pipala
*Attorney, Agent, or Firm*—Burns, Doane, Swecker & Mathis

[57] ABSTRACT

A copying apparatus in accordance with the present invention is provided with an automatic document feeder in the main body of the copying apparatus. The automatic document feeder has a document transport portion for moving and stopping a document; a document feed portion for feeding the document to the document transport portion; and a document discharge portion for receiving the document sent from the document transport portion. The document feed portion includes a plurality of document feed units which are provided in a detachable manner. The document discharge portion has a plurality of detachable document discharge units which are placed one upon another in a vertical direction. By thus constructing the automatic document feeder, document feed units can be coupled freely in a desired manner of utilization so that copy processing can be performed.

38 Claims, 26 Drawing Sheets

FIG.7

| PARAMETER / DOCUMENT FEED UNIT NUMBER | DOCUMENT EXISTS | COPY BEING DONE | SEQUENCE NUMBER | NUMBER OF COPIES | DISCHARGE UNIT NUMBER |
|---|---|---|---|---|---|
| 1 | 1 | 1 | 2 | 10 | 4 |
| 2 | 1 | 0 | 3 | 3 | 1 |
| 3 | 0 | 0 | 1 | 5 | 5 |
| ⋮ | ⋮ | ⋮ | ⋮ | ⋮ | ⋮ |
| n | – | – | – | – | – |

FIG.11

| DECIMAL CODE | BINARY CODE | | | | PAPER SIZE |
|---|---|---|---|---|---|
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | A5 LENGTH |
| 4 | 0 | 1 | 0 | 0 | B5 LENGTH |
| 5 | 0 | 1 | 0 | 1 | A4 LENGTH |
| 6 | 0 | 1 | 1 | 0 | B4 LENGTH |
| 7 | 0 | 1 | 1 | 1 | A3 LENGTH |
| 8 | 1 | 0 | 0 | 0 | |
| 9 | 1 | 0 | 0 | 1 | |
| 10 | 1 | 0 | 1 | 0 | B5 WIDTH |
| 11 | 1 | 0 | 1 | 1 | A4 WIDTH |
| 12 | 1 | 1 | 0 | 0 | |
| 13 | 1 | 1 | 0 | 1 | |
| 14 | 1 | 1 | 1 | 0 | |
| 15 | 1 | 1 | 1 | 1 | CASSETTE IS EMPTY |

ADF WITH MULTIPLE DETACHABLE FEED AND DISCHARGE SECTIONS

BACKGROUND OF THE INVENTION

1. Field of the Invention

This invention relates to a copying apparatus having an automatic document feeder. More particularly, this invention relates to a copying apparatus having an automatic document feeder including a plurality of trays for placing documents to be fed.

2. Description of the Prior Art

Various techniques are proposed in the prior art with a view to meeting demands for multijob processing in copy operation of a copying apparatus. One of the important requirements for multijob processing is to simplify handling of documents to be copied. Such a problem in handling of documents leads to how an automatic document feeder is constructed. The simpler is the construction of an automatic document feeder, the better is the function thereof. Under the circumstances, proposals have been made to provide a plurality of document inlets and/or document outlets.

Such proposals can be seen for example in U.S. Pat. No. 3,687,540 and Japanese Patent Laid-Open Gazette No. 50260/1980. U.S. Pat. No. 3,687,540 discloses a multijob copying machine comprising a plurality of trays for carrying thereon original forms and each of the trays is provided with memory means for storing the number of copies. However, it does not clearly indicate handling of a document already copied. On the other hand, according to Japanese Patent Laid-Open Gazette No. 50260/1980, there are provided a plurality of document placing tables and a plurality of document receiving tables so that copied documents fed from the document placing tables are placed on the corresponding document receiving tables. Copy conditions for a document in each document placing table are set by a button.

However, both of the above described copying machines have a construction in which the trays or tables are provided in a manner inseparable from the main body of the copying machine, which makes it difficult for users to effectively utilize such copying machines with document placing trays. More specifically, as manners of utilization of copying machines by users, there are known a distributed manner in which copying machines are provided for the respective departments of a company or the like and a centralized manner in which copying machines are utilized in a copy center commonly for the respective departments of a company or the like. In addition, the manners of utilization are also determined in view of various factors such as the number of users, the number of jobs for each user etc. An automatic document feeder is usually provided in a copying machine by option and the optimum design for an automatic document feeder is determined necessarily by the manner of utilization of the copying machine concerned. However, in such a conventional copying machine, the number of document feeding trays is fixed and accordingly it is difficult to meet the requirements of users pursuing enhancement of cost performance.

SUMMARY OF THE INVENTION

Therefore, a primary object of this invention is to provide a copying apparatus having an automatic document feeder for multijob processing which can be adapted freely to various manners of utilization by users.

Briefly stated, there are provided, detachably in a main body of a copying apparatus, a plurality of document feed means for feeding documents and a plurality of document discharge means for storing discharged documents. Each document fed from the document feed means is transported to a document exposure position, where it is copied, and the copied document is stored in any of the plurality of document discharge means.

Therefore, according to the present invention, a plurality of document feed means and a plurality of document discharge means are provided detachably as units independent of the main body of the copying apparatus, which makes it possible to provide an arbitrary and most suitable number of document feed means and document discharge means in the main body of a copying apparatus according to the manners of utilization. In addition, makers need only to manufacture a single kind of document feed means and document discharge means and they need not prepare plural kinds of document feed means and document discharge means according to the manners of utilization. Accordingly, the manufacturing cost can be reduced.

According to another aspect of the invention, the order of operation is determined by the order in which documents are set on the document placing tables of a plurality of document feed means. The documents are fed to an exposure position sheet by sheet according to the determined order so that the documents thus fed are copied successively at the exposure position.

Consequently, according to the above stated aspect of the invention, a sequence number in the copy order is automatically determined only by placing documents on a document placing table of any of the document feed means and as a result it is made possible to remove such restriction as in a conventional machine in which documents can not be copied without following the copy order determined by the sequence numbers fixed for the respective document feed means. In addition, such troublesome work as designation of the copy order by operation of keys can be avoided. Thus, the present invention makes improvements in simplification of handling and facility of use.

According to a further aspect of the invention, copy conditions are set for the respective documents placed on the document placing tables of the respective document feed means and the order of operation of the document feed means is determined by the order in which the copy conditions are set. Documents are fed, in the order thus determined, to an exposure position sheet by sheet from the document feed means so that the documents are copied according to the set copy conditions.

Therefore, according to this aspect of the invention, if copy conditions for the respective documents are set in advance, the documents can be copied in the set copy conditions in the set order and thus handling can be simplified.

In addition, according to a still further aspect of the invention, while documents are being fed from the respective document feed means to an exposure position sheet by sheet and copied at the exposure position according to the order set by operation order setting means, any of the sequence numbers in the operation order allotted to the respective document feed means can be cancelled by removing a document from any of the document feed means before it is copied, whereby the sequence numbers of the feed means subsequent thereto are set again to be decremented by one.

Consequently, according to this aspect of the invention, if a document is removed after the order of transport of the documents has been determined, the order of continuous transport is automatically determined again and thus operation for changing the order is not required and continuous transport processing is never interrupted.

According to a still further aspect of the invention, it is determined whether a document is contained in each of the plurality of document discharge means, and any on of the document discharge means containing no document is designated based on this determination so that a copied document is contained in the designated document discharge means. If all of the plurality of document discharge means contain documents, copy operation for the subsequent document is interrupted after the end of the copy operation of the document which is presently being copied.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a table showing data stored in a RAM contained in a third CPU.

FIG. 11 is a table showing paper size codes.

DESCRIPTION OF THE PREFERRED EMBODIMENTS

In the following, the present invention will be specifically described in connection with embodiments shown in the attached drawings.

Figure 1:
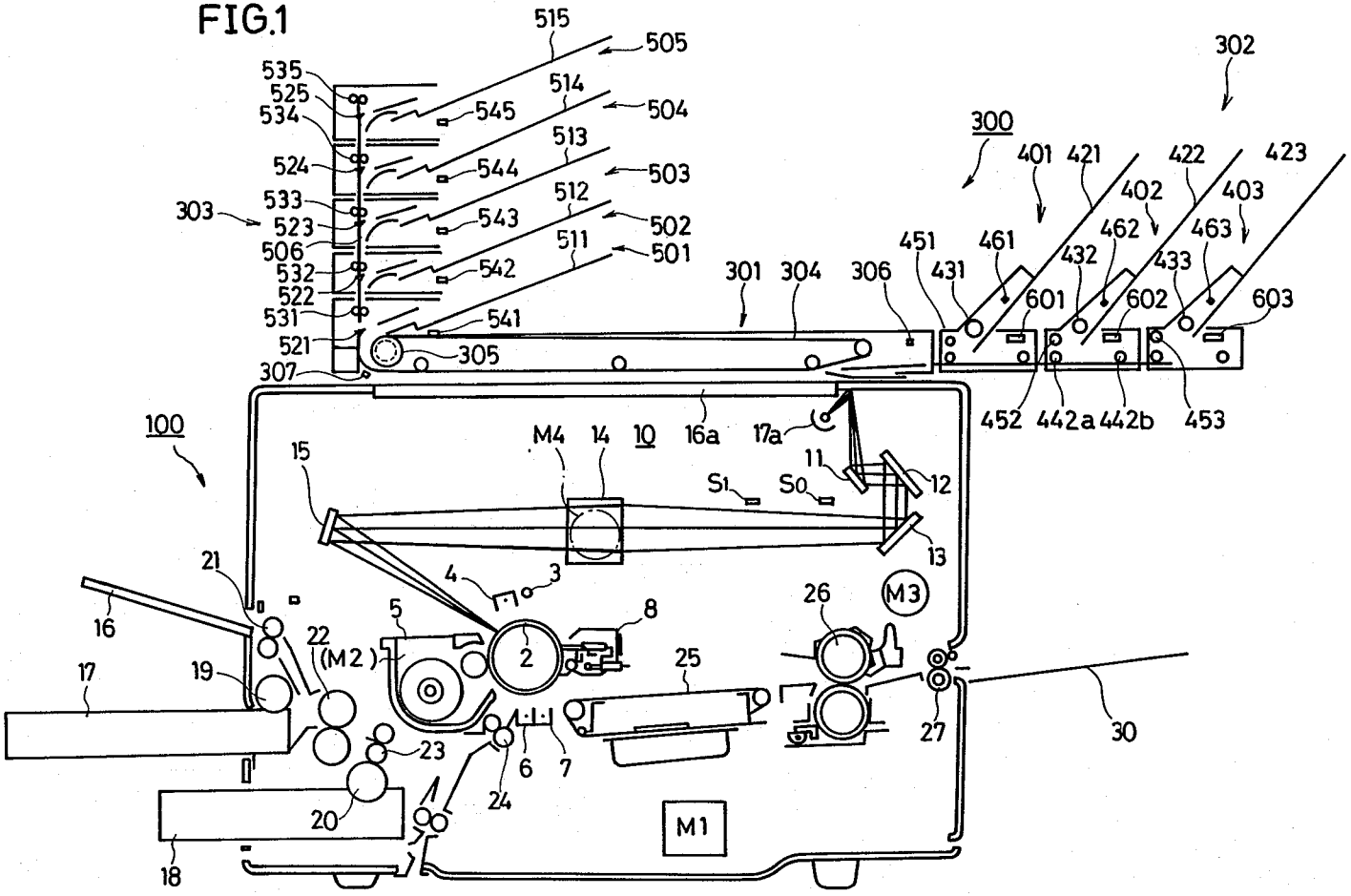
FIG. 1 is a schematic block diagram showing a copying apparatus of an embodiment of the present invention.

FIG. 1 is a schematic sectional view of a copying apparatus according to an embodiment of the invention. An automatic document feeder 300 is mounted on the upper portion of a main body 100 of the copying apparatus.

The main body 100 of the copying apparatus is of a dust figure transfer type and a photoreceptor 2 in the form of a drum is provided nearly in the central portion of the main body. There are provided around the photoreceptor 2, an eraser lamp 3, an electrification charger 4, a developing device 5 having a motor M2, a transfer charger 6, a separation charger 7 and a cleaning device 8. The photoreceptor 2, while it rotates, is subjected to an imaging exposure from a scanning optical system 10. The scanning optical system 10 is provided under a document glass plate 16*a* and this scanning optical system 10, which is driven by a motor M3, comprises an exposure lamp 17*a*, movable mirrors 11, 12 and 13, an imaging lens 14 and a reflection mirror 15.

The exposure lamp 17*a* and the movable mirror 11 move to the left in FIG. 1 at a speed V/n (n being a magnification) in relation to a turning speed V of the photoreceptor 2 (which is constant irrespective of whether an equal magnification or a variable magnification is selected) and the movable mirrors 12 and 13 also move to the left at a speed V/2n. When the magnification is changed, a motor M4 starts to operate. Movement of the scanning optical system 10 is detected by sensors S0, S1 etc. Paper is fed from a manually attached table 16 or an upper or lower cassette 17 or 18. The paper introduced by a clutch-operated roller 19 or 20, or an inlet roller 21 passes through intermediate rollers 22 and 23 and stops temporarily by a timing roller 24 so that it is sent to a transfer portion in synchronism with the rotation of the photoreceptor 2. The paper sent to the transfer portion is subjected to transfer of a toner image by the transfer charger 6. Then, it is separated from the photoreceptor 2 by the separation charge 7 and is sent to a fusing device 26 by means of a transport belt 25, so that it is subjected to thermal fusion. After that, it is discharged to a copy tray 30 by means of a discharge roller 27. The motor M1 drives operation elements of the paper transport system.

The automatic document feeder 300 comprises: document transport portion 301 for moving and stopping a document on the document glass plate 16*a*; a document feed portion 302 for feeding a document to the above stated document transport portion 301; and a document discharge portion 303 for receiving the document sent from the above stated transport portion 301. The document transport portion 301 transports a document by means of a rotation belt 304 driven by a motor 305. A sensor 306 is provided at the inlet of a document so as to detect feeding of the document. A sensor 307 is provided at the outlet so as to detect discharging of the document.

The document feed portion 302 comprises detachable document feed units 401, 402 and 403. The unit 401 is coupled to the document transport portion 301; the unit 402 is coupled to the unit 401; and the unit 403 is coupled to the unit 402. The unit 402 comprises a document tray 422 for placing thereon a plurality of sheets of documents, a delivery roller 432 for delivering the documents sheet by sheet, document transport rollers 442*a* and 442*b*, and an operation panel 602. The other units 401 and 403 comprise entirely the same components as described above. The delivery roller 432 and the rollers 442*a* and 442*b* are operated by a motor 452 provided in the unit 402. The sensor 462 detects existence or nonexistence of any document on the document tray 422.

Figure 2:
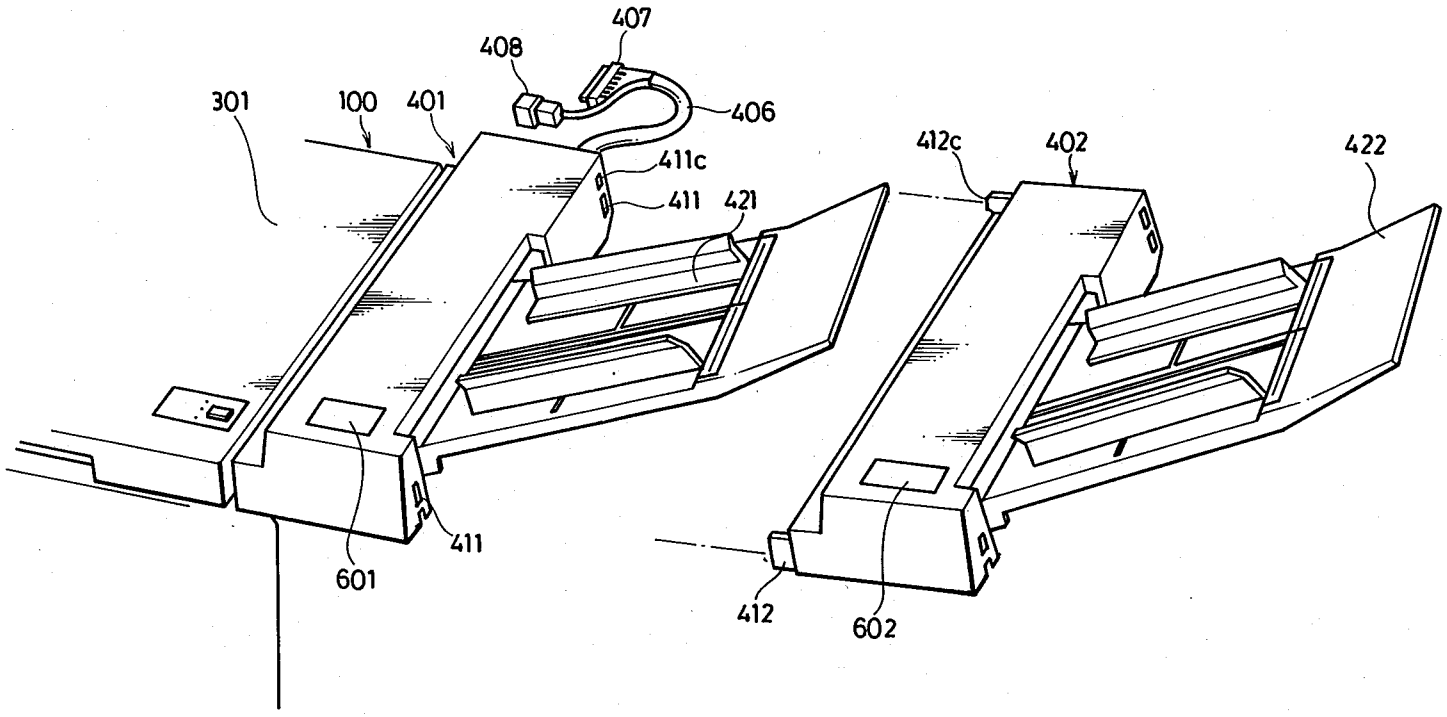
FIG. 2 is a perspective view showing a concrete example of a document feed unit.

FIG. 2 shows a concrete example of the document feed units. As can be seen from the unit 402 shown in FIG. 2, coupling portions for coupling units to one another are provided at a forward end and a backward end of the casing of each unit. At the forward end of the casing, there are provided coupling claws 412 projecting forward from both lateral sides of the casing so that they are fitted in coupling holes 411 formed at the backward end of the casing of the forwardly provided unit. Those units are connected electrically by connectors 412c and 411c. Connection of the units by connectors establishes a channel for supply of electric power and signals among the respective units. The unit 401 coupled to the document transport portion 301 has also a connector 412c in principle so that it can be electrically connected to the above stated document transport portion 301. However, in order to make electrical connection more stably, a cable 406 may be drawn from the unit 401 so that a signal line connector 407 and a power supply connector 408 can be connected to the document transport portion 301 or the main body 100 of the copying apparatus by means of this cable 406.

The document discharge portion 303 has multiple outlet trays 511 to 515 vertically arranged, as shown in FIG. 1. Document discharge units 501, 502, 503, 504 and 505 separable from one another are provided corresponding to the respective outlet trays. The document discharge unit 501 is coupled to the document transport portion 301; the document discharge unit 502 is coupled to the unit 501; the unit 503 is coupled to the unit 504; and the unit 505 is coupled to the unit 504. When those document discharge units 501 to 505 are coupled, a transport path 506 for the discharged document is established from a lower level to an upper level. Those document discharge units 501 to 505 comprise selection claws 521 to 525, respectively, for turning the discharged document to the transport path 506 or to the respective outlet trays. Those units 501 to 505 also comprise roller pairs 531 to 535, respectively, for sending the document to the transport path 506. Each of the selection claws 521 to 525 is operated by an electromagnetic solenoid coupled thereto. Each of the roller pairs 531 to 535 is operated in principle by a small-sized motor provided in each unit. However, those roller pairs may be operated by the driving force of an externally provided motor 305 or the motor in the document transport portion 301. Sensors 541 to 545 provided under the outlet trays 511 to 515, respectively, detect existence of any document in the respective outlet trays.

Figure 3:
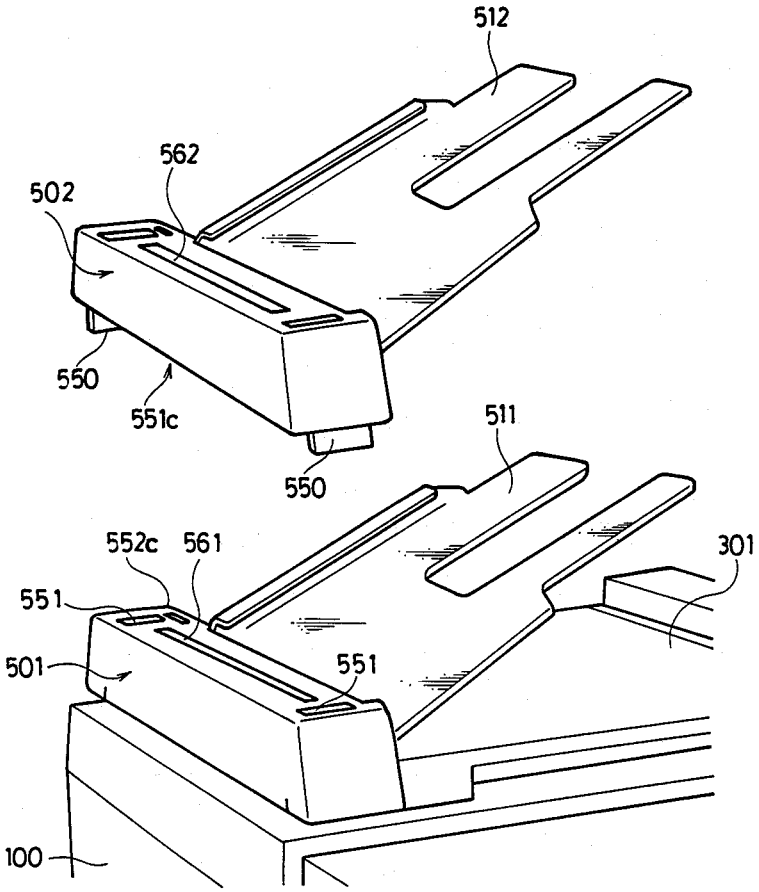
FIG. 3 is a perspective view showing a concrete example of a document discharge unit.

FIG. 3 shows a concrete example of the document discharge units. The document discharge units 501 and 502 are coupled to each other when the coupling claws 550 formed on the lower surface of the casing of the unit 502 are fitted in the coupling holes 551 formed on the upper surface of the casing of the unit 501. The units 501 and 502 are connected electrically by coupling a connector 551c (not clearly shown) projecting downward from the lower surface of the casing of the unit 502 to a connector 552c provided in the upper portion of the casing of the unit 501. Elongate holes 561 and 562 as well as elongate holes in the lower surfaces of the respective casings serve as outlets and inlets for making a document pass through the units.

Figure 4:
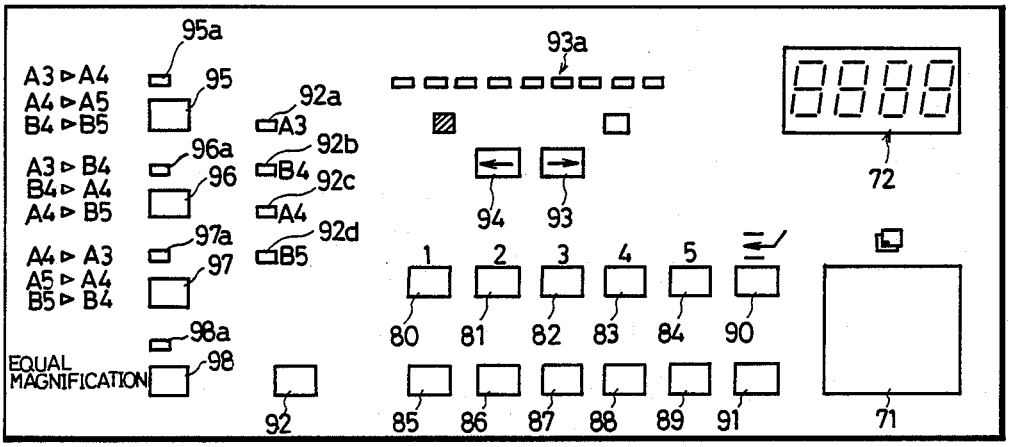
FIG. 4 is a typical plan view of an operation panel of a main body of a copying apparatus.

FIG. 4 shows an operation panel provided in the main body 100 of the copying apparatus. The operation panel comprises a print key 71 for starting copy operation and a display 72 for indicating the number of copies. Ten keys 80 to 89 are used principally to input the number of copies. The operation panel further comprises a key 90 for interruption copy and a clear/stop key 91 for cancelling the set number or interrupting copy operation. A paper select key 92 is a key for selecting any of the paper feed openings arranged vertically. When any of the paper feed openings is selected, any of the paper size display portions 92a to 92d is illuminated based on paper size data coded in the cassettes 17 and 18. The density of an image to be copied can be set by steps by means of exposure up/down keys 93 and 94. A display portion 93a indicates a magnitude of the set density. Magnification selection keys 95 to 98 are used to select reduction and enlargement modes shown on the left. When any of those modes is selected, the corresponding one of display portions 95a to 97a is lighted. In an ordinary case not selecting any of the enlargement and reduction modes an equal magnification is applied as an initial mode and a display portion 98a is lighted.

This panel is in principle used for a copying apparatus of an ordinary type not having multijob function. If this panel is used for a copying apparatus having a multijob function, setting of jobs (such as selection of a paper size or a magnification) is made by option keys (not shown in FIG. 4) provided for the purpose of performing the multijob function. However, if the panel is made to have an automatic paper size selecting function and an automatic magnification selecting function, it is not necessarily needed to provide keys for multijob function.

Figure 5B:
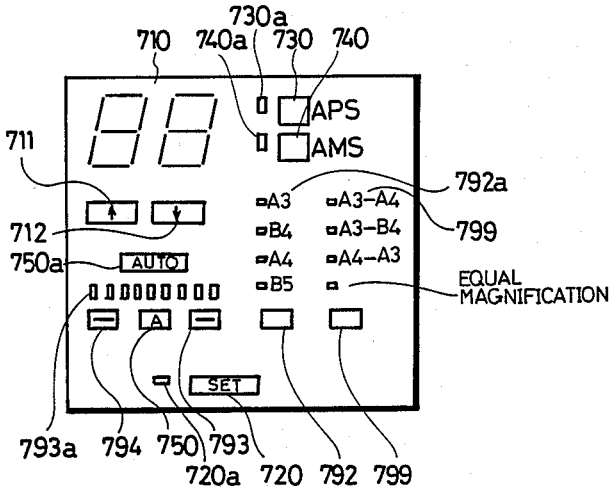
FIG. 5B is a typical plan view of an operation panel of another embodiment of the invention.
Figure 5A:
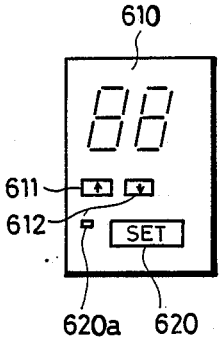
FIG. 5A is a typical plan view of an operation panel of a document feed unit.

FIG. 5A shows an operation panel of a document feed unit in this embodiment of the invention. This operation panel comprises a numerical value display of two digits of a 7-segment system for displaying the number of copies for one sheet of a document. An increment key 611 and a decrement key 612 are used to set the number of copies. This operation panel further comprises a set end key 620 for definitely using a displayed numerical value as the number of copies. When this set end key 620 is pressed, a display 620a is lighted to indicate an end of setting.

FIG. 5B represents another example of an operation panel of a document feed unit. The operation panel shown in FIG. 5B is constructed to have functions which are nearly the same or better than the functions of the operation panel of the main body of the copying apparatus. The operation panel in FIG. 5B comprises a copy number display 710, an increment key 711 and a decrement key 712 for displaying a numerical value, a selection key 730 of an automatic paper selection mode, a display 730a of the automatic paper selection mode, a selection key 740 of an automatic magnification selection mode, a display 740a of the automatic magnification selection mode, a selection key 750 of automatic exposure, a display 750a of the selection of automatic exposure, an up key 793 and a down key 794 for manual exposure regulation, a display 793a for displaying a set density by steps, a paper select key 792 for selecting a paper size, a display 792a for displaying a selected paper size, a magnification select key 799, and a display 799a for displaying a selected magnification. This operation panel further comprises a set end key 720 to be used after completion of setting in this panel, as well as a display 720a for displaying an end of the setting. By using the operation panel thus constructed, copy conditions can be finely set independently for each of the document feed units. Consequently, as compared with the case of setting copy conditions by the panel of the main body, there are advantages that errors can be avoided in setting copy conditions as well as in copy operation.

Figure 6A:
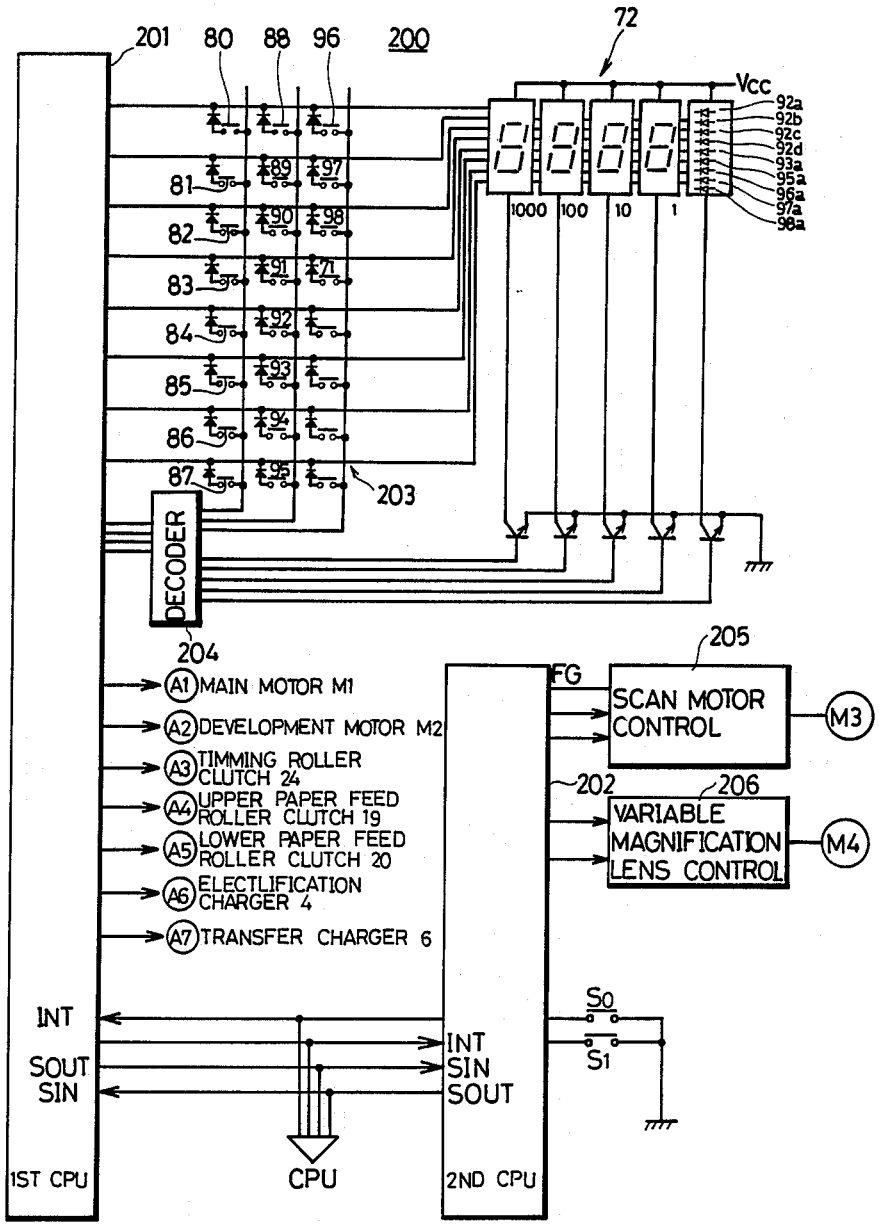
FIGS. 6A and 6B are diagrams of control circuits in a copying apparatus of an embodiment of the invention.
Figure 6B:
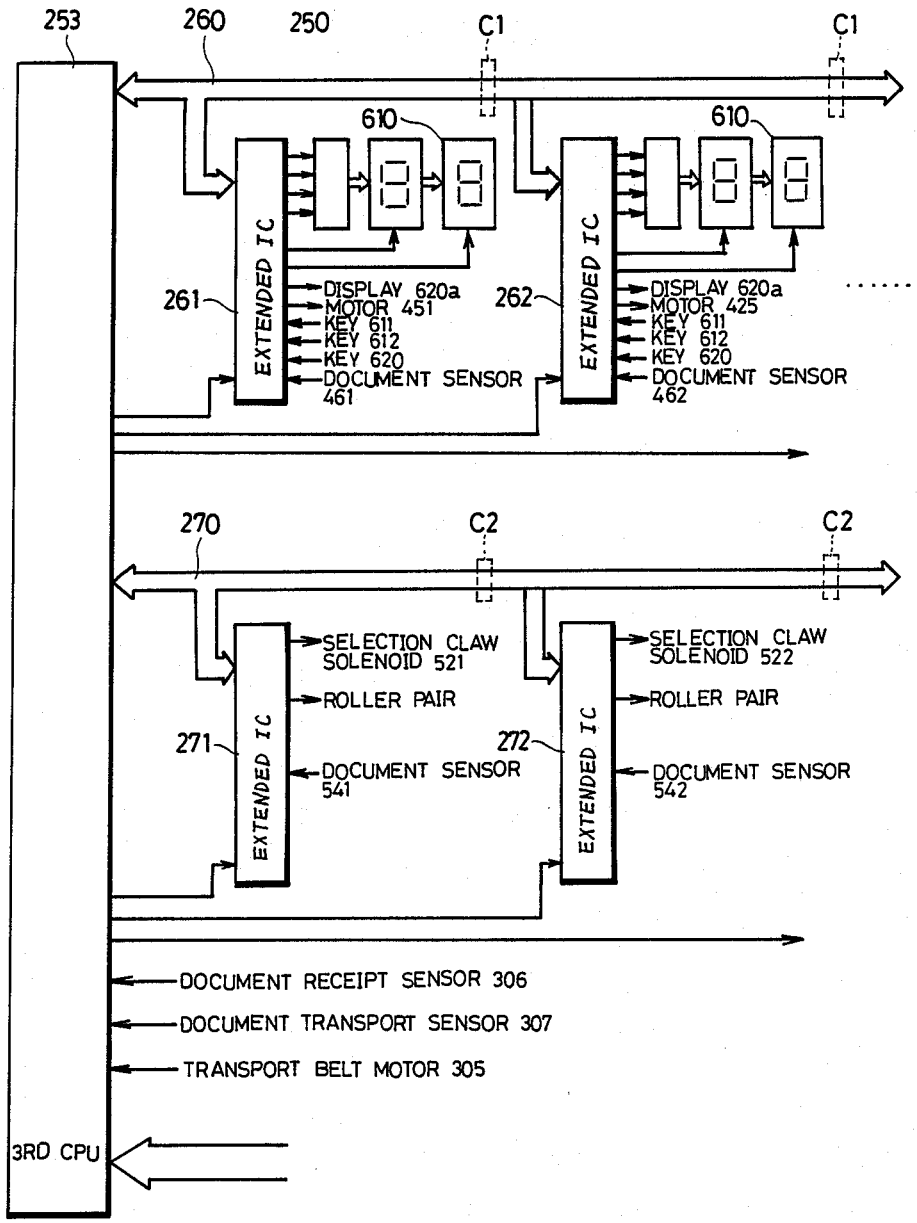

FIGS. 6A and 6B show schematically control circuits of a copy system in the embodiment of the invention.

A circuit 200 is provided in the main body 100 of the copying apparatus and this circuit 200 comprises a microcomputer 201 (namely, a first CPU) for control of copy operation and a microcomputer 202 (namely, a second CPU) for control of a scanning optical system. On the other hand, a circuit 250 is provided in the automatic document feeder 300 and this circuit 250 comprises a microcomputer 253 (namely, a third CPU) for controlling the operations of the document transport portion 301, the document feed portion 302 and the document discharge portion 303 which constitute the automatic document feeder 300.

The first CPU 201 is connected through a decoder 204 to a switch matrix 203 comprising key groups of the operation panel and switches of various sensors, the copy number display 72, and light emitting diodes 92*a* to 92*d* and 93*a* to 98*a*. An output port for control of copy operation is connected with the respective driving circuits (not shown) of a main motor Ml, a development motor M2, a timing roller clutch 24, upper and lower paper feed roller clutches 19 and 20, an electrification charger 4, a transfer charger 6 etc. In addition, an interruption signal input terminal INT and data input and output terminals Sin and Sout are connected with the associated terminals of the second CPU 202 and the third CPU 253 so that communication of data is made mutually. The second CPU 202 is connected with a scan motor control circuit 205, a variable magnification lens control circuit 206, scanning control sensors S0 and S1 etc.

Referring to FIG. 6B, the third CPU 253 provided in the automatic document feeder is connected to a signal bus 260 for the document feed portion 302 and to a signal bus 270 for the document discharge portion 303. As for the document transport portion 301, there are at least provided sensors 306 and 307 connected to an input port of the transport portion 301 and a driving portion of a transport belt motor 305 connected to an output port thereof.

The signal bus 260 is extensible through a connector portion C1. The connector portion C1 comprises a connector 411*c* and a connector 412*c* as shown in FIG. 2. The signal bus 260 is connected with input/output extended IC's 261, 262 etc. in parallel incorporated in the respective document feed units. For this extended IC, a product 8243 of Intel Corporation, for example, may be used. The extended IC 261 is connected through a driver to the copy number display 610 of the operation panel of the document feed unit and also connected to the set end display 620*a* and the keys 620, 611 and 612. A document sensor 461 in the unit 401 is connected to an input terminal and a motor 451 for transport of document is connected to an output terminal through the driver The extended IC's 262 etc. of the other units 402 etc. are connected entirely in the same manner.

The signal bus 270 is also extensible through a connector portion C2 as in the case of the above stated bus 260. The connector portion C2 comprises a connector 551*c* and a connector 552*c* as shown in FIG. 3. Input-/output extended IC's 271, 272 etc. incorporated in the respective document discharge units are connected in parallel with the signal bus 270. The extended IC 271 incorporated in the discharge unit 501 is connected in principle to a solenoid for operating a document sensor 541 and a document transport path selection claw 521. The extended IC's of the other discharge units 502, 503 etc. are also connected entirely in the same manner.

FIG. 7 is a table showing data stored in memory areas of a RAM incorporated in the third CPU 253. Referring to FIG. 7, the numeral at the left end of each row of the table corresponds to a unit number of a document feed unit and the numerals of each column correspond to various parameters such as existence or nonexistence of a document, a state in copy operation, a sequence number of copy operation, the number of copies and a unit number of a discharge unit. A section defined by an intersection of a row and a column has a length of one byte. The significations of the respective parameters are as follows. In the column "document", "1" is given if a document exists and "0" is given if no document exists. In the column "copy being done", "1" is given if the document group concerned is being copied and "0" is given if the document group is not being copied. The column "sequence number" indicates the sequence number according to which the document group fed by the document feed unit is to be copied. The column "number of copies" indicates the number of copies for one sheet of a document group. The column "discharge unit number" indicates the unit number of a document discharge unit to which the document fed from the document feed unit is discharged. The discharge unit number is made to correspond, in advance, to a document feed unit with a one-to-one relation.

In the following, control procedures of the first CPU 201 and the third CPU 253 will be described with reference to the flow charts in FIG. 8 et seq.

Figure 8:
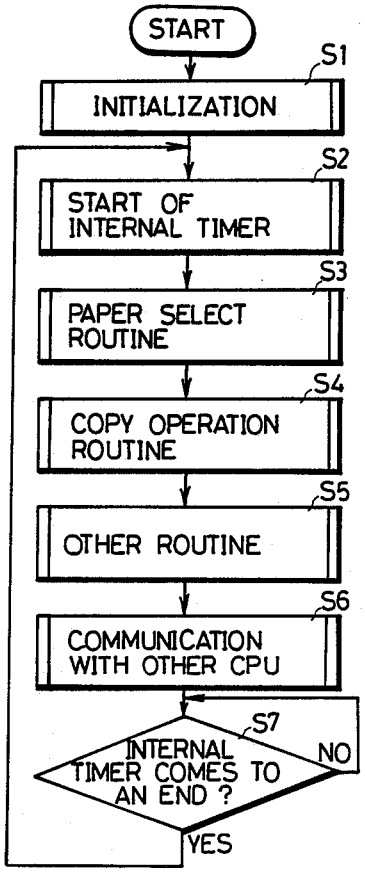
FIG. 8 is a main flow chart in a first CPU.

FIG. 8 is a general flow chart of a program incorporated in the first CPU 201. When the CPU 201 is reset, the program starts. First, the CPU 201 makes initialization in the step S1 to clear the RAM and to set the registers to initial values. Then, in the step S2, the CPU 201 sets a prescribed value in the incorporated counter circuit used as an internal timer so as to start measurement of the internal timer. In the steps S3 to S6, the CPU 201 calls subroutines successively. When all the subroutines are completed, the CPU 201 waits for an end of the measurement of the previously set internal timer in the step S7 and completes processing of one routine. The CPU 201 determines a period set for a software timer in a subroutine by using the length of the period of one routine. In other words, a value measured by the timer is determined by a count value of one routine. After having called all of the subroutine related to operations of the copying apparatus, the CPU 201 performs communication of data with the second CPU 202 and the third CPU 253 according to a prescribed communication control subroutine.

Figure 9:
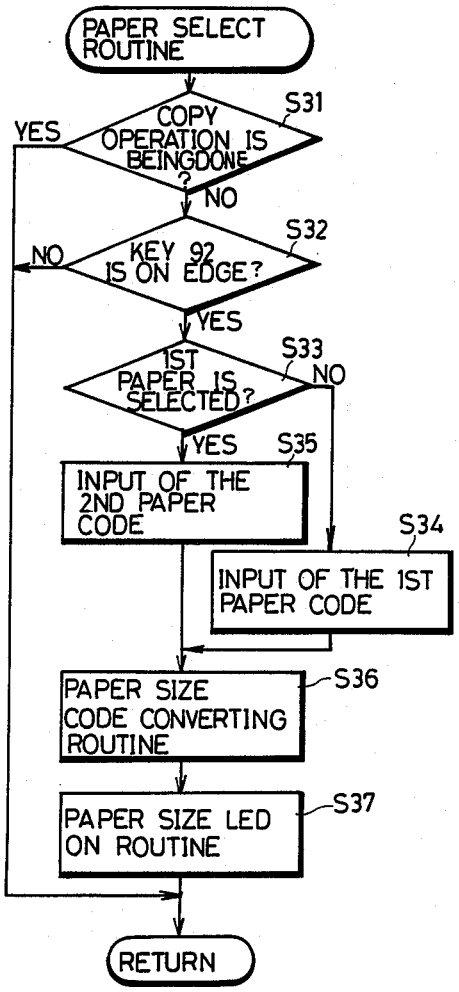
FIGS. 9 and 10 are flow charts showing a subroutine of an embodiment of the present invention.

FIG. 9 is a detailed flow chart of a paper select routine. If the paper select key 92 is turned on when copy is not being done, the CPU 201 selects, by a leading edge of the ON signal, a second paper feed (a lower paper feed) if a first paper feed (an upper paper feed) is selected at present or selects the first paper feed if the second paper feed is selected at present. Then, the CPU 201 reads and inputs the paper size code by means of a magnet provided in the cassette 17 or 18 in FIG. 1 and a reed switch in the main body corresponding to the magnet (in the steps S31 to S35). In the step S36, the CPU 201 calls a paper size converting routine for converting the paper size code to a real size value and in the final step S37, a light emitting diode 92*a*, 92*b*, 92*c* or 92*d* in the operation panel corresponding to the paper size code thus read is turned on.

Figure 10:
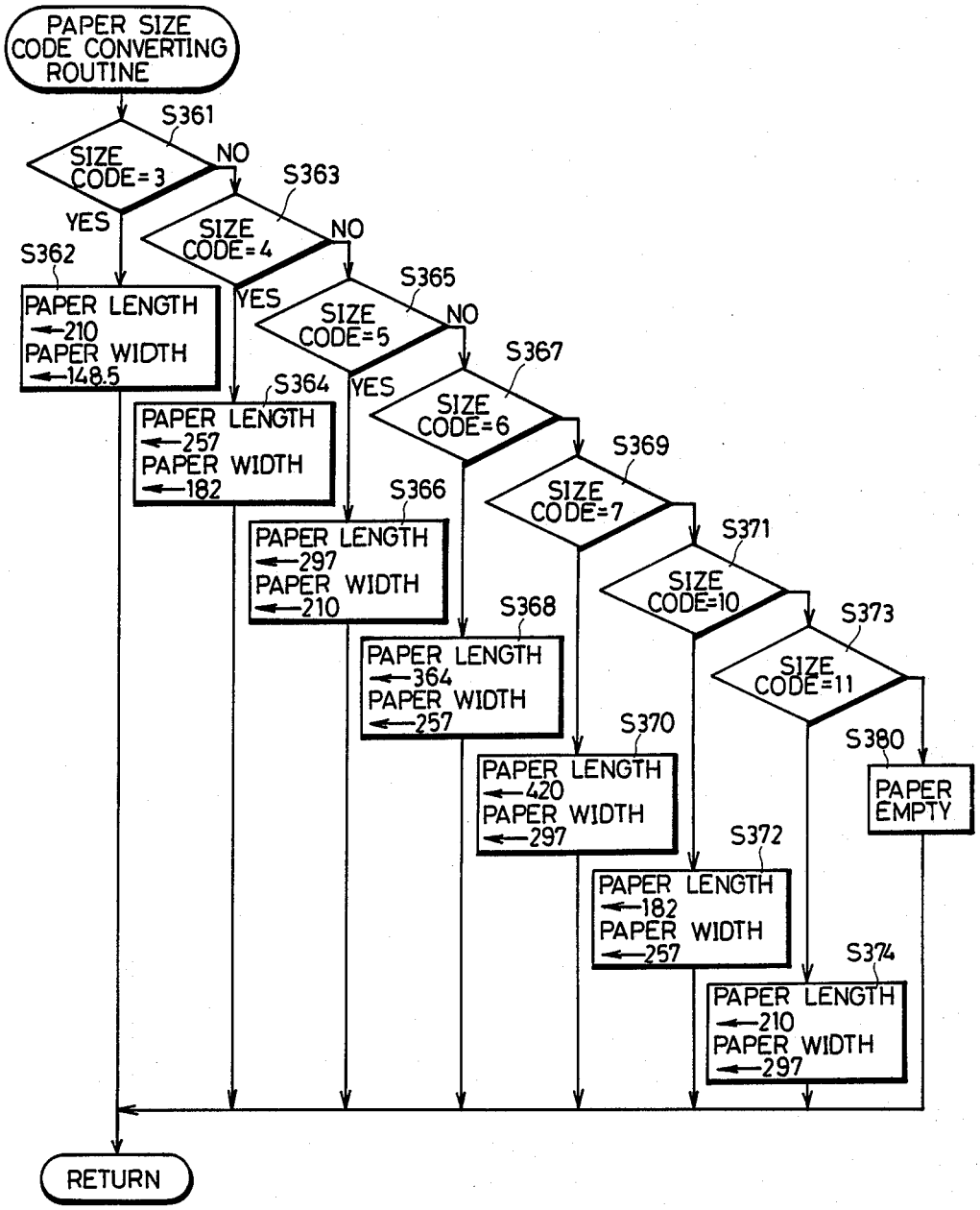

FIG. 10 shows details of the above stated paper size converting routine and FIG. 11 shows corresponding relations between the paper sizes and the codes. Numerical values in millimeters concerning a real size, a paper length and a paper width corresponding to each paper size code are stored in memory (in the steps S362, S364 to S374).

Figure 12A:
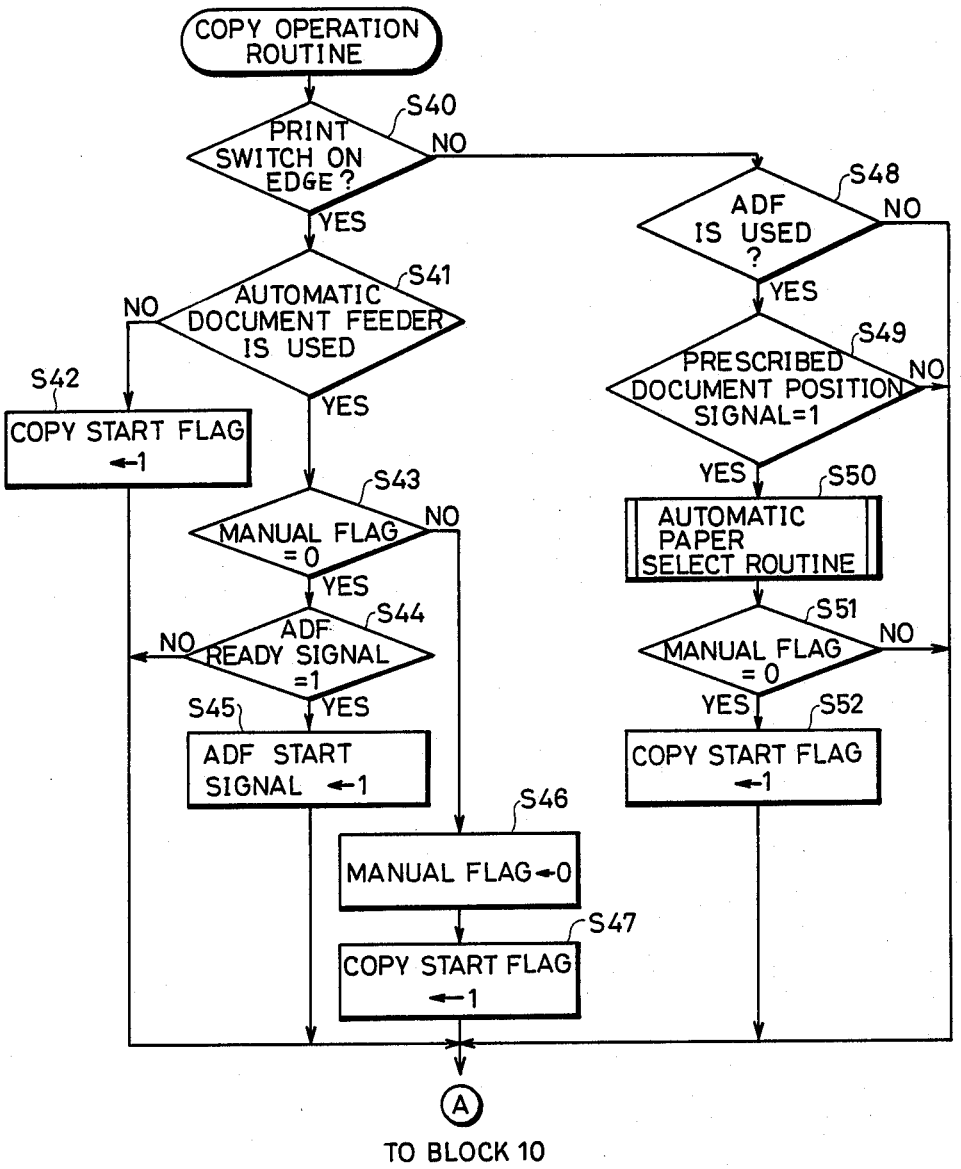
FIGS. 12A, 12B, 12C and 13 are flow charts showing a subroutine.
Figure 12B:
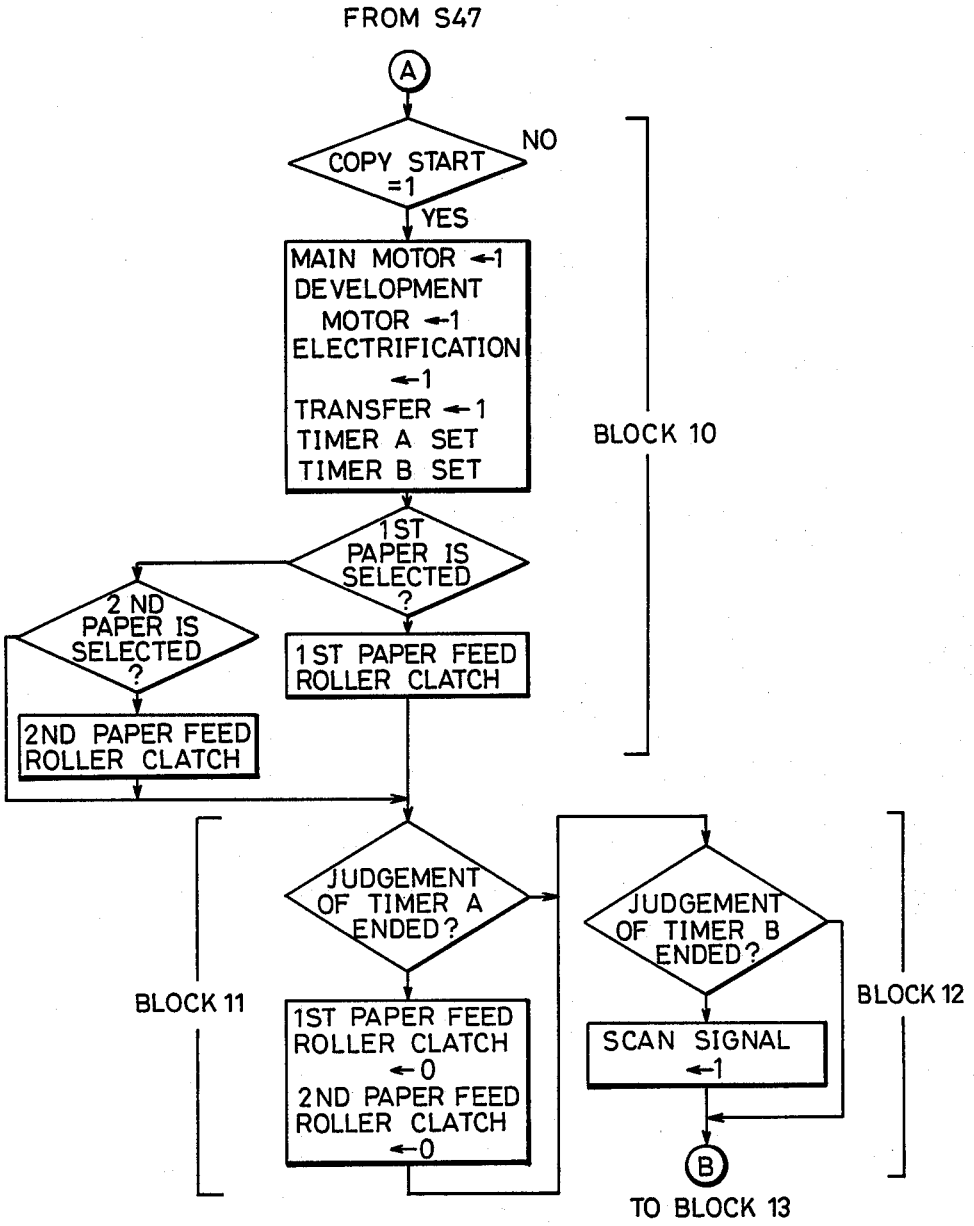
Figure 12C:
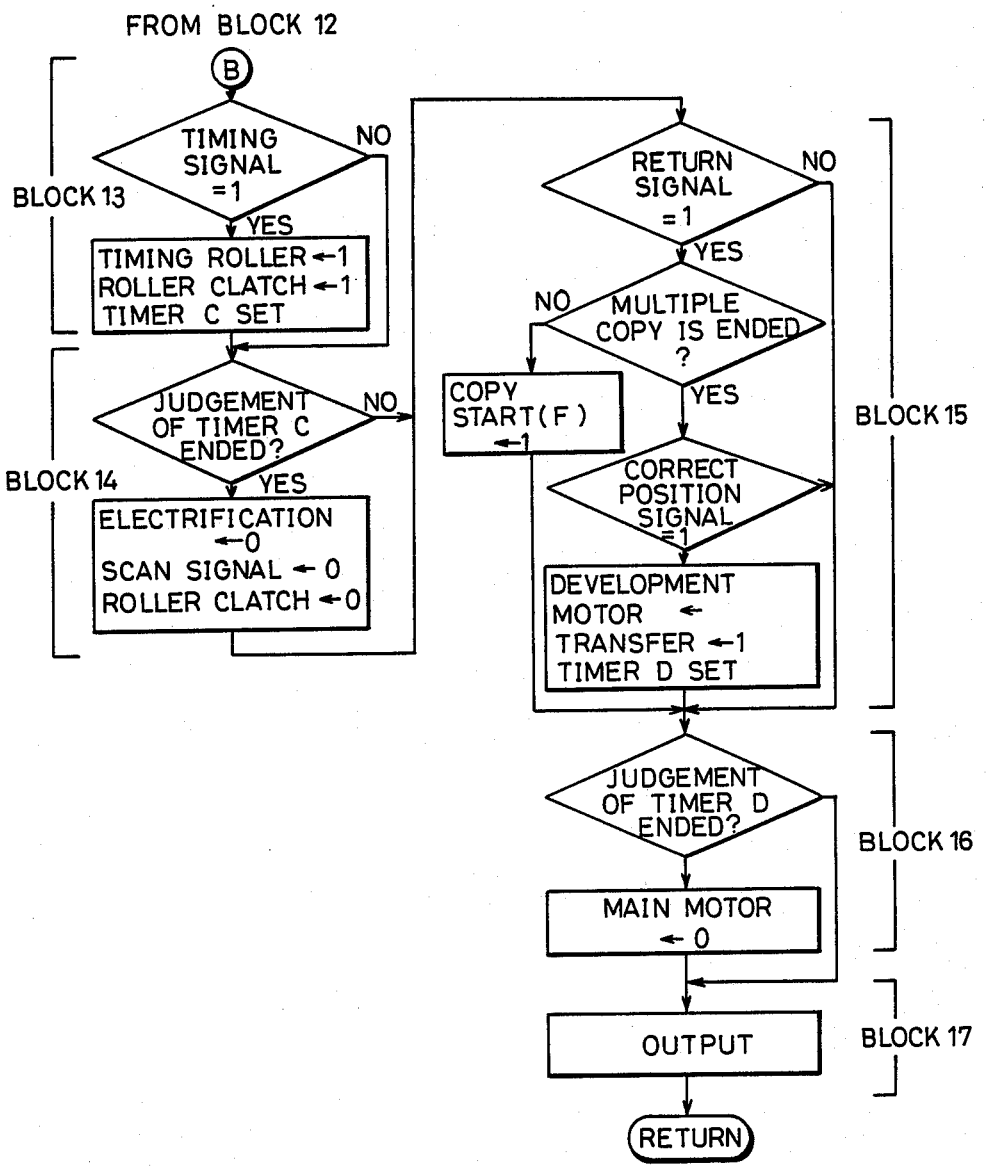

FIGS. 12A, 12B and 12C show details of a copy operation routine. A copy start flag in those flow charts is set at the time of starting copy operation. A manual flag is set when suitable paper can not be found by an automatic paper selector APS. When the CPU 201 determines, in the step S40, the leading edge of the ON signal of the print switch (the print key 71), it immediately sets the copy start flag to 1 when an automatic document feeder is not provided. If an automatic document feeder is provided, the CPU 201 determines an automatic document feeder ready signal from the automatic document feeder when the manual flag is set to 0. If the manual flag is set to 1, the CPU 201 sets the automatic document feeder start signal to 1 (in the steps S43 to S45). On the other hand, if suitable paper can not be found by the automatic paper selector as described below when the manual flag is set to 1, the CPU 201 returns the manual flag to 0 by turning on the print switch and then sets the copy start flag to 1 (in the steps S46 and S47).

When the print switch is not turned on in the case of using the automatic document feeder, the CPU 201 determines a prescribed position signal from the automatic document feeder in the step S49 and when the prescribed position signal becomes 1, the CPU 201 searches for a cassette containing paper of a suitable size in the automatic paper select routine (in the step S50). If paper of a suitable size is found by the search (the manual flag is set to 0), the CPU 201 sets the copy start flag to 1 (in the step S52).

Referring to FIG. 12B, the CPU 201 first determines the copy start flag. When the copy start flag is determined to be 1, the main motor, the development motor, the electrification charger and the transfer charger are turned on and the roller clutch CL at the selected paper feed opening is turned on. Then, the copy start flag is returned to 0 and the timers T-A and T-B are set (in the block 10). The timer T-A controls the ON periods of the clutches of the paper feed rollers 19 and 20. The timer T-B controls start of scanning. In the block 11, the CPU 201 determines the state of the timer T-A and when the timer T-A comes to an end, it turns off the paper feed roller clutch. In the block 12, the CPU 201 determines the state of the timer T-B and when the timer T-B comes to an end, it sets the scan signal to 1.

Referring to FIG. 12C in the block 13, when the timing signal becomes 1, the CPU 201 turns on the clutch of the timing roller 24 and sets a timer T-C. The timer T-C controls operation of the timing roller 24 synchronizing with imaging. In the block 14, the CPU 201 determines an end of measurement of the timer T-C and at the end timing, it turns off the electrification charger and the timing roller clutch and sets the scan signal to 0. In the block 15, the CPU 201 determines the state 1 of a return signal provided when the scanner returns to a home position. When the return signal becomes 1, the CPU 201 determines whether copy operation for a multiple number of copies is completed and if it is not completed, the CPU 201 sets again the copy start flag to 1. If the copy operation is completed, the CPU 201 waits for the prescribed position signal emitted when the scanner returns to the home position and then, the CPU 201 turns off the development motor and the transfer charger and sets a timer T-D. In the block 16, the CPU 201 determines an end of measurement of the timer T-D and at the end timing, it turns off the main motor. In the final block 17, the CPU 201 outputs a logical signal for real operation.

Figure 13:
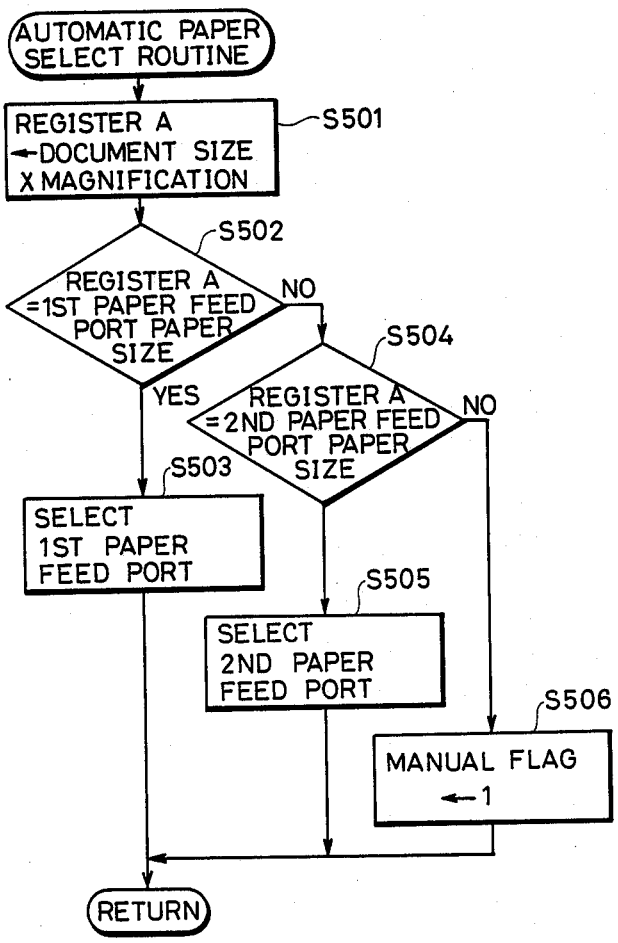

FIG. 13 is a flow chart of the automatic paper select routine in the above described copy operation routine. In the step S501, the CPU 201 stores a result of multiplication of the document size value and the magnification value in a register A and then compares the content of the register A and the real size data of the paper size in the upper and lower paper feed openings. If an appropriate paper feed opening exist, the CPU 201 selects it (in the steps S502 to S505). If such an appropriate paper feed opening does not exist, the manual flag is set in the step S506 and the program returns to the main routine.

Figure 14:
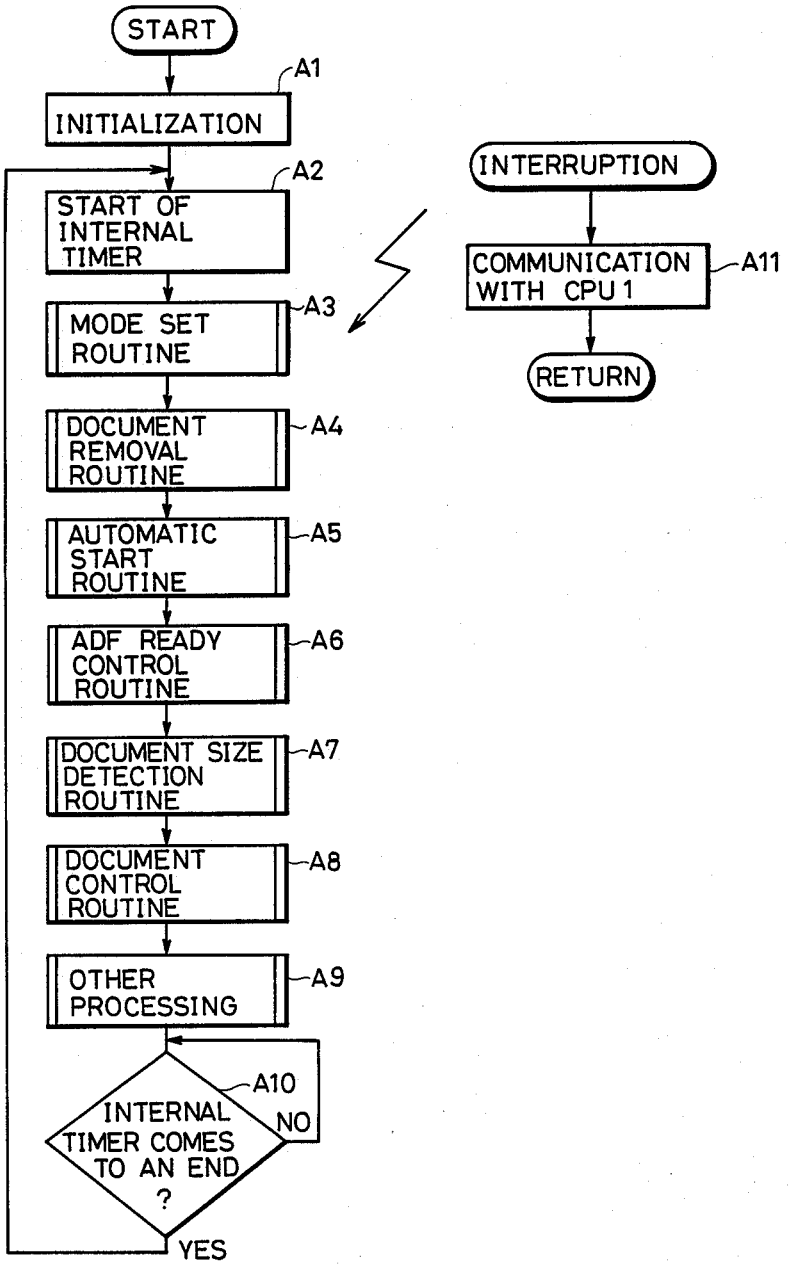
FIG. 14 is a main flow chart in the third CPU.

FIG. 14 is a general flow chart of a program of a CPU 253 for controlling operation of the automatic document feeder. When the program starts, the CPU 253 clears the content of the incorporated RAM and initializes the registers in the step A1. Then, the CPU 253 starts measurement of the internal timer and calls successively the subroutines shown in this flow chart (in the steps A3 to A9). The CPU 253 determines an end of measurement of the internal timer in the final step A10 and when this internal timer comes to the end, the CPU 253 starts again measurement of the internal timer (in the step A2) so that the loop is repeatedly executed. The CPU 253 uses a period of one routine of the loop for measurement of a software timer. Data communication between the first CPU 201 and the second CPU 253 is made by an interruption routine according to an interruption request from the CPU 201, independently of the main routine. In the following, the subroutines will be described in detail.

Figure 15:
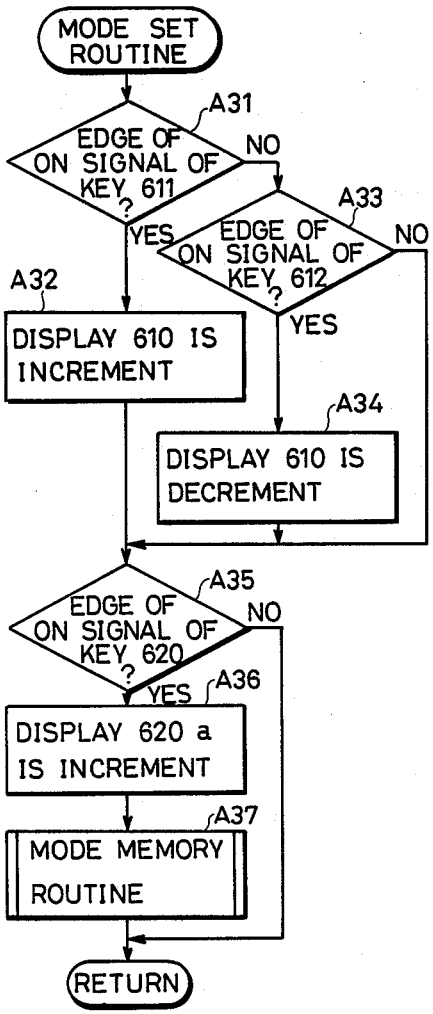
FIGS. 15, 16, 17, 18, 19, 20, 21, 22, 23, 24, 25 and 26 are flow charts showing subroutines.

FIG. 15 shows details of a mode set routine. In this routine, processing is performed to set the memory areas in the RAM map shown in FIG. 7 by data based on input operation and arithmetic operation.

First, the CPU 253 increments the copy number display 610 by the edge of the ON signal provided by the key 611 in the step A31. On the other hand, the CPU 253 decrements a displayed numerical value by the edge of the ON signal provided by the key 612. When the CPU 253 determines the edge of the ON signal provided by the set key 620, it turns on, namely, illuminates the set end display 620*a* and calls a mode memory routine (in the steps A35 to A37).

Figure 16:
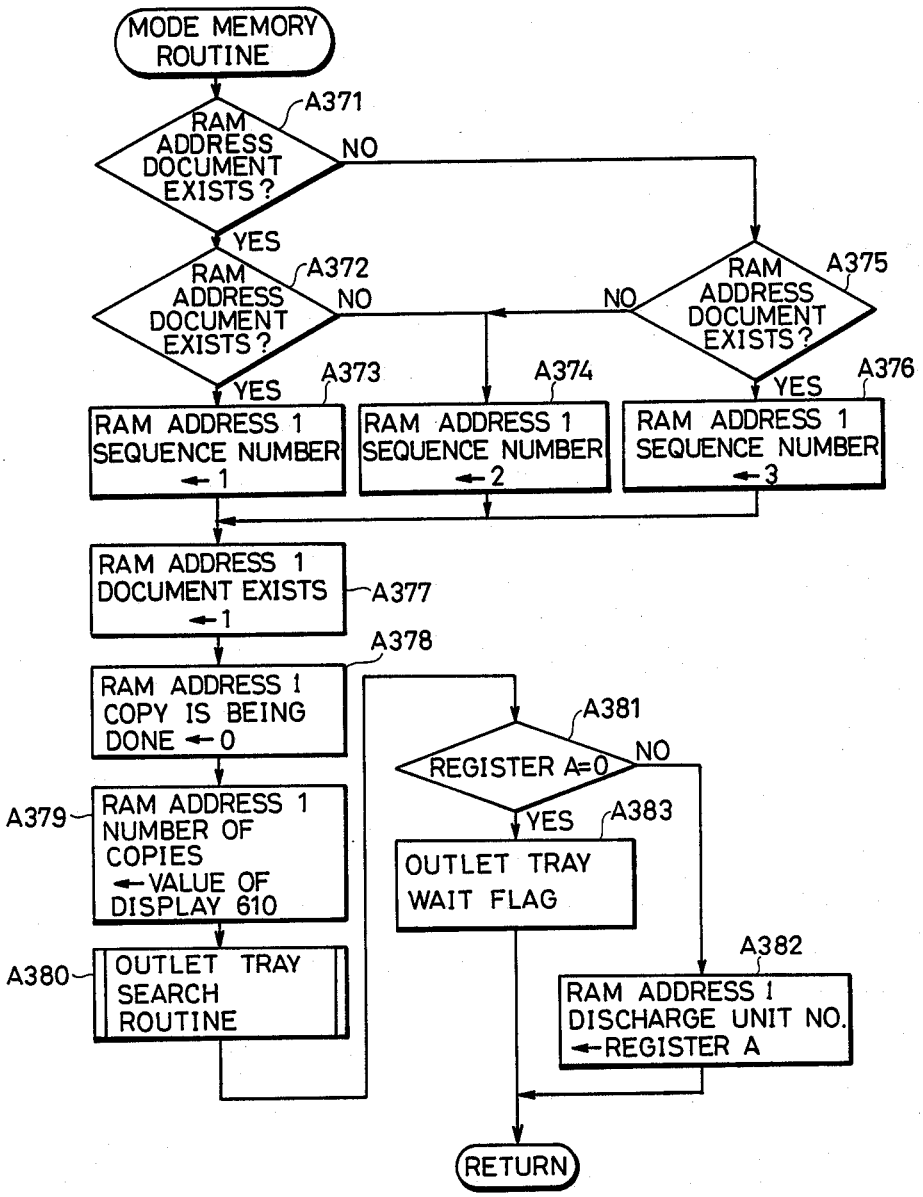

FIG. 16 shows an example of the mode memory routine (in case where a document is set in the document feed unit 401). First, in the steps A371 to A376, the CPU 253 determines a sequence number for copying this document dependent on whether documents are set in other units 402 and 403. The unit number N corresponds to the RAM address N. The CPU 253 examines data in the document areas of the RAM addresses 2 and 3. If the data in those RAM addresses 2 and 3 are "0" and "0", the sequence number 1 is set in the sequence number area of the unit number 1; if they are "0" and "1", the sequence number 2 is set in that area; and if they are "1" and "1", the sequence number 3 is set in that area. In other words, the order of copy operation in this example is determined by the setting order of the documents without selecting a particular order of priority. After the sequence number has been set, the CPU 253 sets "1" in the document area, "0" in the copy area and the numerical value of the display 610 in the copy number area (in the steps A377 to A379). Then, in order to determine an outlet for this document, the CPU 253 calls an outlet tray search routine. The CPU 253 stores the value of the register A in the discharge unit number area of the RAM address 1. If the value of the register A is 0, which means the state in which documents exist in all of the trays of the discharge units, the CPU 253 sets an outlet tray wait flag to 1 (in the steps A380 to A383).

Figure 17:
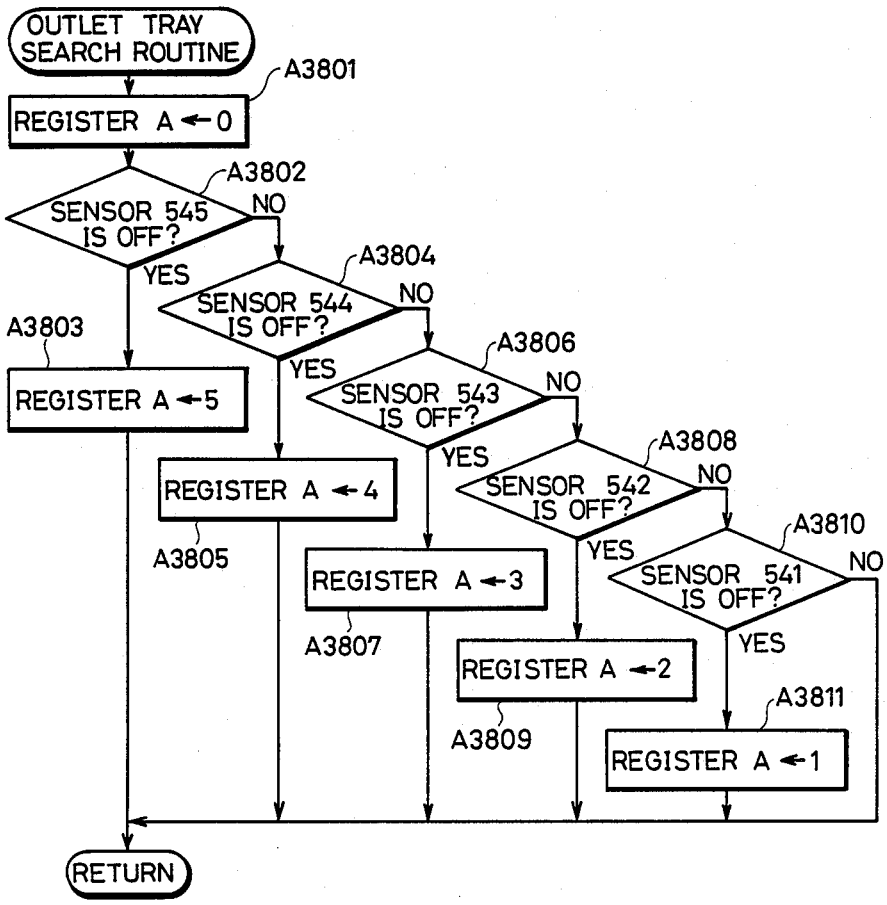

FIG. 17 shows the outlet tray search routine. First, the CPU 253 resets the register A in the step A3801 and sets the register A to a value 5, 4, 3, 2 or 1 dependent on nonexistence of documents in the outlet trays detected by document sensors 545 to 541 (in the steps A3802 to A3811). As can be seen from the flow chart in FIG. 17, automatic allotment of the outlet trays is made according to an order of priority in which selection is made successively from the uppermost outlet tray to the lowermost outlet tray, in view of the fact that it is easier for a user to remove the documents in upper trays. In other words, although the discharge portion for document or the like is formed as multiple trays arranged vertically, as in case of sorters, based on the demand for a compact size of an apparatus, this routine serves to cover, by control operation, such disadvantage in handling of document outlet trays due to such arrangement.

Figure 18:
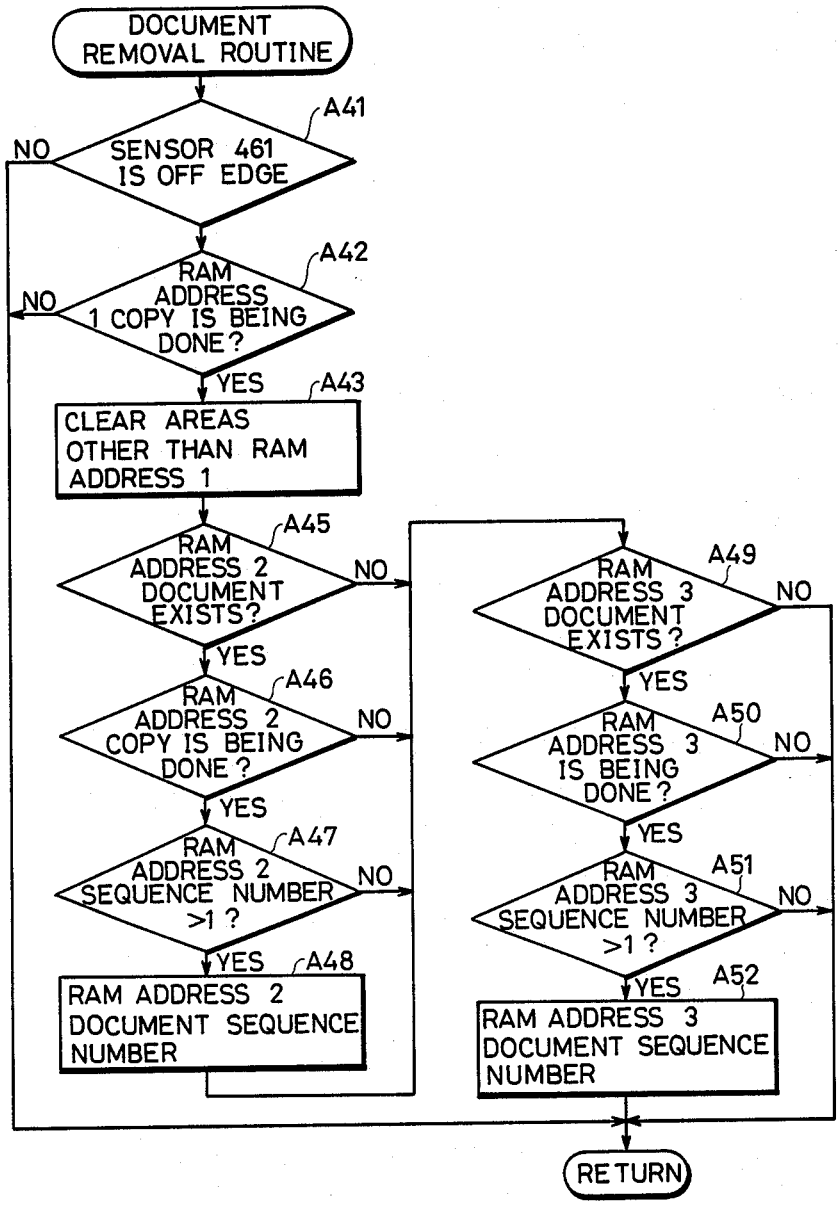

FIG. 18 shows details of a document removal routine. As shown in FIG. 16, if documents are set, sequence numbers for copy operation of those documents are automatically allotted according to the setting order of the documents. However, it sometimes happens that any of the documents is removed for some reason. In this routine in FIG. 18, processing is performed to allot again sequence numbers for copy operation in such cases. In this example in FIG. 18, the sequence numbers of the documents coming later than the sequence number of the document removed are decremented. More specifically, FIG. 18 shows a case in which after documents have been set in three units, the document in the unit 401 is removed. In this case, the CPU 253 first determines an edge of an OFF signal provided by the document sensor 461 in the step A41. When it is determined that the copy operation area of the RAM address 1 is 0, the sequence numbers of all the areas except the sequence number of the RAM address 1 are cleared (in the steps A42 and A43).

Then, the CPU 253 checks the flags in the RAM address 2 indicating that the document exists and that copy operation is not being done, and the CPU 253 determines whether the sequence number of the RAM address 2 is larger than the sequence number of the RAM address 1. If the sequence number of the RAM address 2 is larger than the sequence number of the RAM address 1, the CPU 253 decrements the sequence number of the RAM address 2 (in the steps A45 to A48). More specifically, if the sequence number of the RAM address 2 is 2, it is decremented to 1 and if it is 3, it is decremented to 2. Subsequently, the CPU 253 performs the same processing for the sequence number of the RAM address 3. If the document of the unit 402 or 403 is removed, processing is performed in the same manner as in the flow chart in FIG. 18. By this automatic changing of the copy order, it is made possible to prevent a loss of time, which would be caused otherwise by stopping operation of a copying machine during prescribed judgement for still starting copy operation of the removed document, or by automatic stop of the copying machine if special means were not provided to continue the job. As is different from this embodiment in which the copy order is determined by the setting order of documents, the copy order might be designated by using keys. In such a case, however, the operation for changing the order is considerably troublesome. By contrast, in the above described embodiment, the copy order can be changed automatically and without any additional operation and thus users can utilize copying apparatus of this embodiment more easily.

Figure 19:
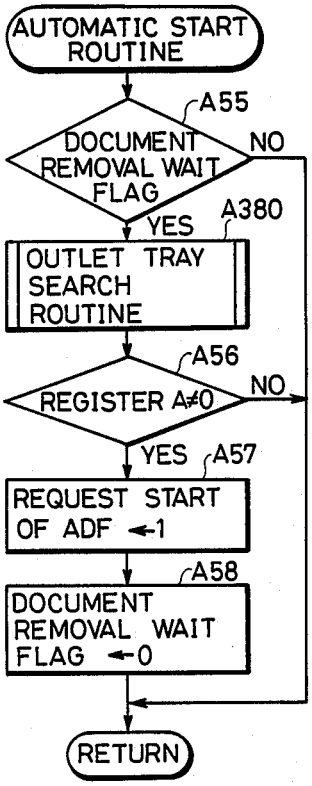

FIG. 19 shows details of the automatic start routine. In this routine, processing is performed to start a job automatically when one of the outlet trays 511 to 515 all containing documents is removed. The document removal wait flag in this flow chart defines a state in wait for removal of the document in any of the outlet trays, stopping advancement to a job in the subsequent step because all of the outlet trays are used.

More specifically, if the document removal wait flag is set to 1, the CPU 253 calls the outlet tray search routine (shown in FIG. 17) and when it determines in the step A56 that the register A is not 0, i.e. that any of the document outlet trays is empty, it sets the automatic document feeder start request to 1 in the step A57. Then, it resets the document removal wait flag (in the step A58). The automatic document feeder start request corresponds to the automatic document feeder start signal transmitted from the main body of the copying apparatus and this is a signal for controlling the automatic document feeder independently, as shown in the flow chart in FIG. 22.

Figure 20:
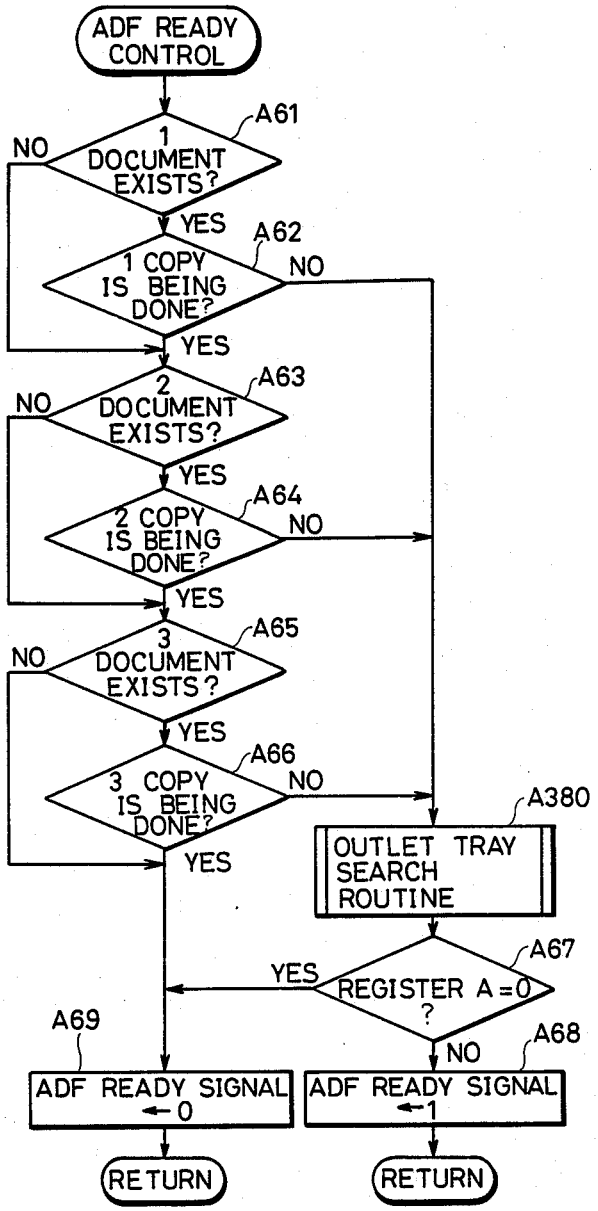

FIG. 20 shows an automatic document feeder ready control routine for communicating information from the automatic document feeder to the copying apparatus as to whether the automatic document feeder is ready to start. If a document is set in any of the document feed trays and any of the document outlet trays is empty, the automatic document feeder is ready to start and the CPU 253 sets the automatic document feeder ready signal to 1. On the other hand, if the automatic document feeder can not be started at present, the CPU 253 sets the automatic document feeder ready signal to 0 (in the step A69). The automatic document feeder ready signal is set to 1 only when the below described determinations are made (in the step A68), that is, when it is determined that a document exists in any of the document feed trays based on 1 in the document area of the RAM map, that the document is not being copied (the copy operation area of the RAM map is not 1), and that a document does not exist in any of the outlet trays according to the outlet tray search routine.

Figure 21:
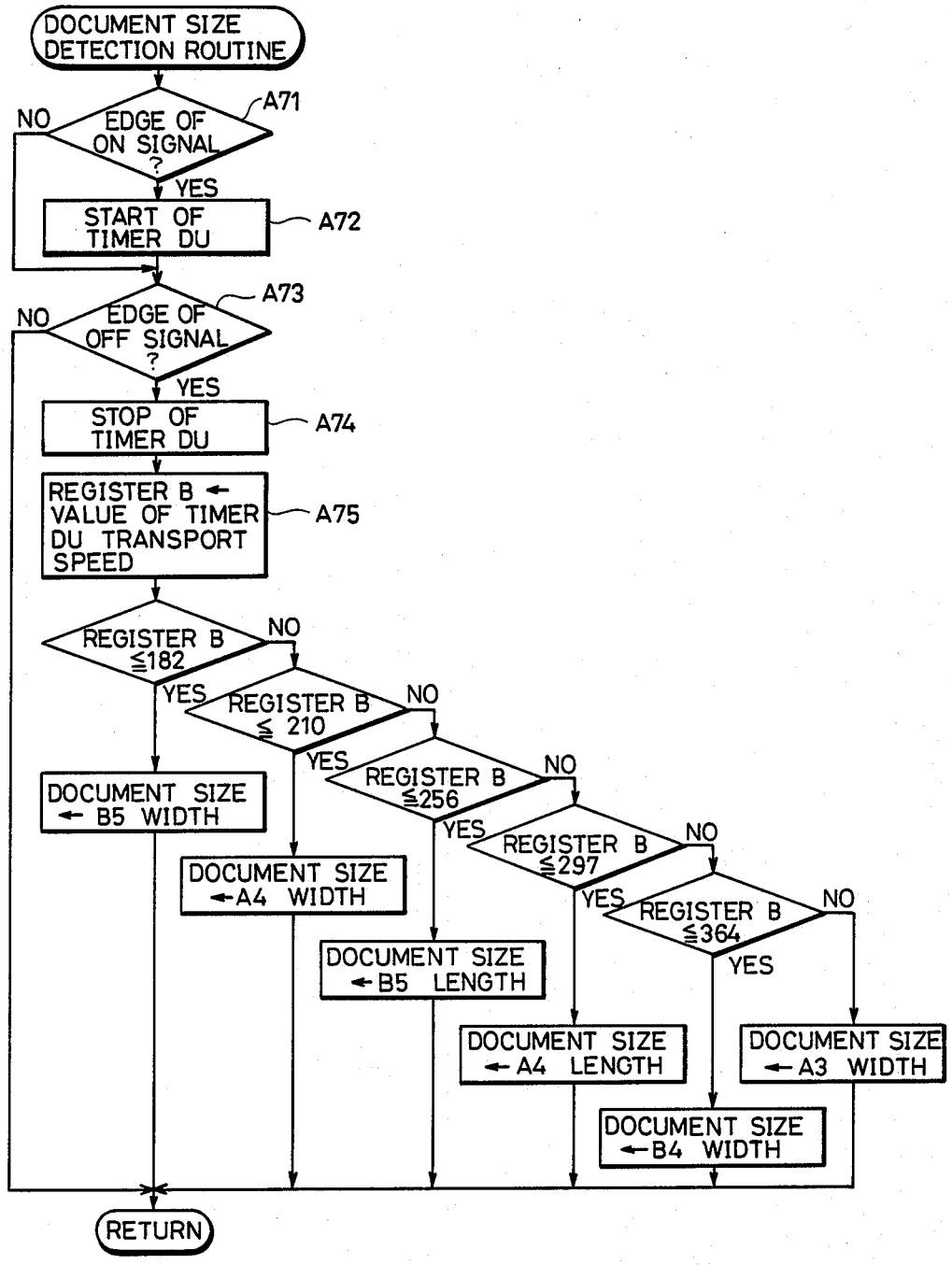

FIG. 21 shows a document size detection routine for automatically detecting a document size in case where an automatic paper selection function or an automatic magnification selection function is adopted. An appropriate standard paper size is determined by detecting a range to which a real size of the document belongs by using a sensor 306 (shown in FIG. 1) and a software timer (in the steps A71 to A75). More specifically, the CPU 253 starts measurement of the timer DU at an edge of an ON signal provided by the sensor 306. Then, the CPU 253 stops the measurement of the timer DU at an edge of an OFF signal provided by the sensor 306, that is, when the trailing edge of the document passed. Subsequently, the CPU 253 multiplies a measured value of the timer DU by a document transport speed (mm/s) known in advance so that the length of the document is stored in a register B. Then, in the step group A76, the CPU 253 compares the content of the register B with the values of the length and the width of the standard paper sizes successively so that an appropriate standard paper size , i.e. any of the formats A or B covering the length and the width of the document is determined.

Figure 22:
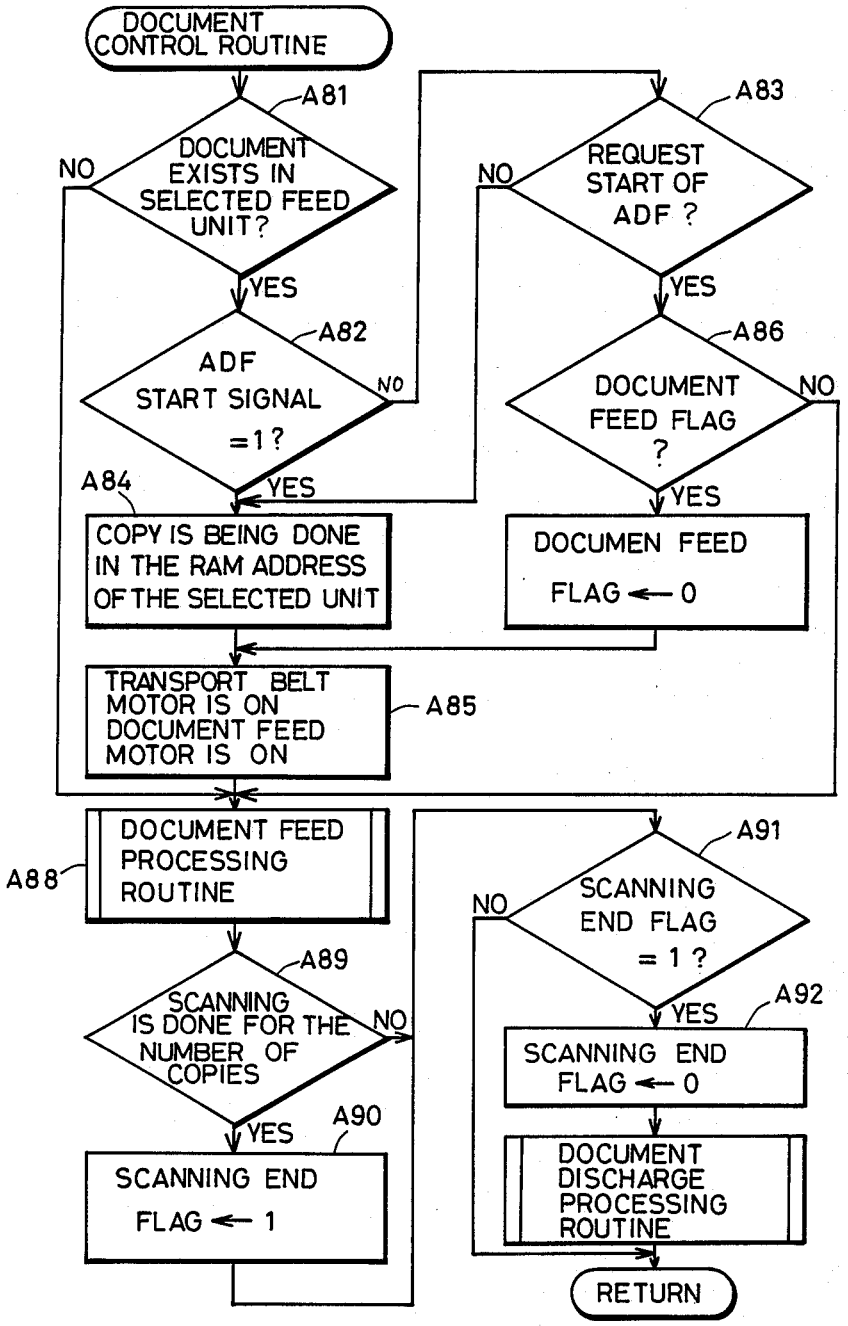

FIG. 22 shows details of a document control routine. In a document feed processing routine, control is made to start operation of a selected document feed unit, to feed the document sheet by sheet from the unit to the document transport portion 301 and to transport the document to the exposure position by the document transport portion 301. Then, in a document discharge processing routine, control is made to transport the document from the exposure position to the document discharge portion 303. In this flow chart, the document feed flag serves to control start of feeding of the second and subsequent sheets of the document and the scan end flag serves to indicate whether scanning for the number of copies set in the operation panel of the unit is completed or not. When scanning for the number of copies of the document set at the exposure position is completed according to the document feed processing routine, the scan end flag is set. By setting the scan end flag, the document discharge processing routine in the final step is started.

In the first step A81 of the document control routine, the CPU 253 determines by the document sensor whether a document exists in the selected document feed unit. If the document exists, the CPU 253 determines whether the automatic document feeder start signal from the main body of the copying apparatus is 1, or whether the automatic document feeder request is 1 if the automatic document feeder start signal is 0. In either of the above stated two cases, the CPU 253 sets 1 in the copy operation area of the RAM address in the selected unit and turns on the transport belt motor 305 and the document feed motor of this unit (in the steps A82 to A85). If the automatic feeder start signal is 0 and the automatic feeder request is 0, the CPU 253 determines the document feed flag. If the document feed flag is 1, the CPU 253 resets this flag and turns on the above stated two motors (in the steps A86, A87 and A85). The document is fed by the feed motor and enters the document transport portion 301 through a transport path.

Figure 23:
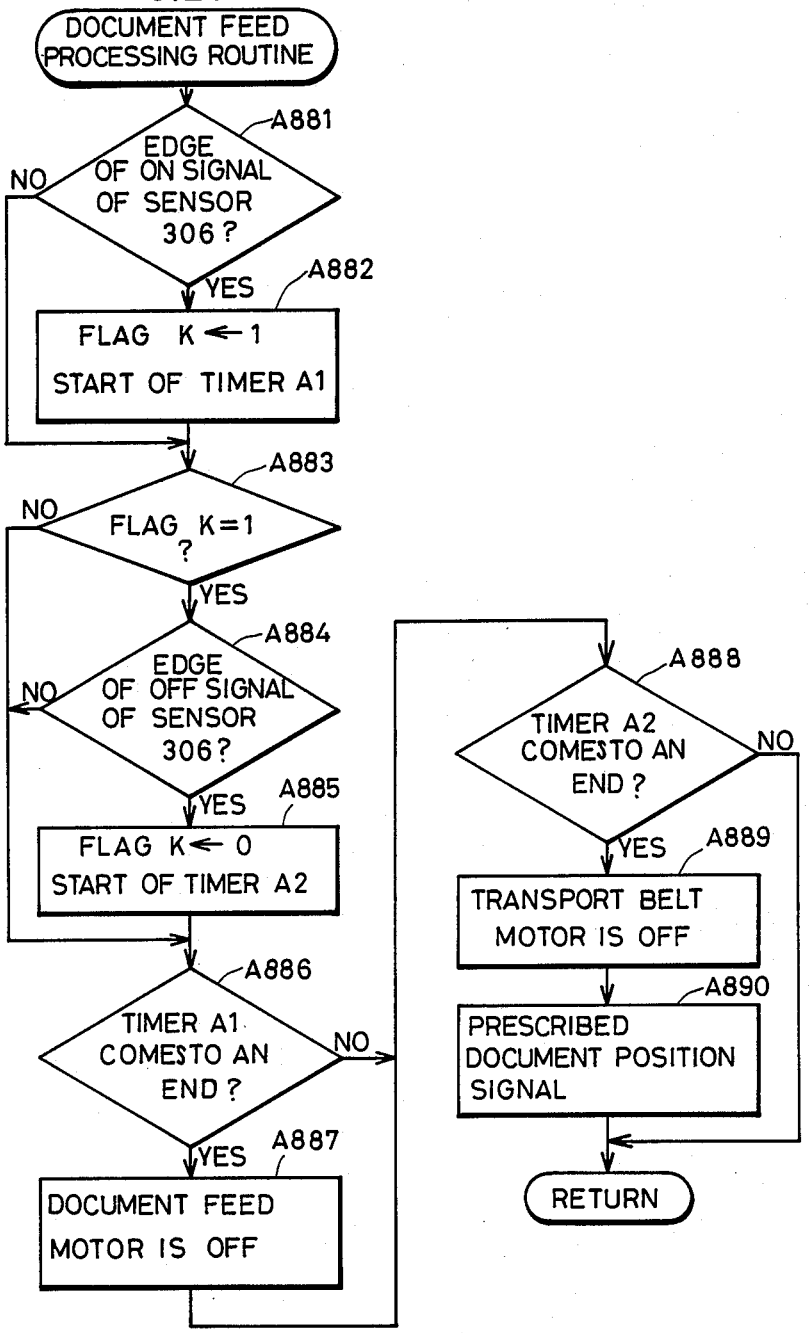

Referring to FIG. 23 showing details of the document feed processing routine (in the step A88), when the sensor 306 detects entrance of the document, the CPU 253 sets a flag K and starts measurement of the timer A1 (in the step A882). The timer A1 serves to turn off the document feed motor and a value for attaining the position where the document is driven by the transport belt 304 is set in this timer A1. Then, when the CPU 253 detects an edge of an OFF signal of the sensor 310 (in the step A884) if the above stated flag K for control of the sensor 306 is 1, that is, when it detects the trailing edge of the document, it resets the flag K to 0 and starts measurement of the timer A2. A value for the trailing edge of the document to attain a prescribed edge position of the document glass plate **16*a* is set in the timer A2. The CPU 253 turns off the document feed motor at the end of the measurement of the timer A1 (in the step A887). Then, the CPU 253 turns off the transport belt motor 305 at the end of the measurement of the timer A2 and sets, to 1, the prescribed position signal transmitted to the CPU 201 (in the steps A888 to A890**).

Figure 24:
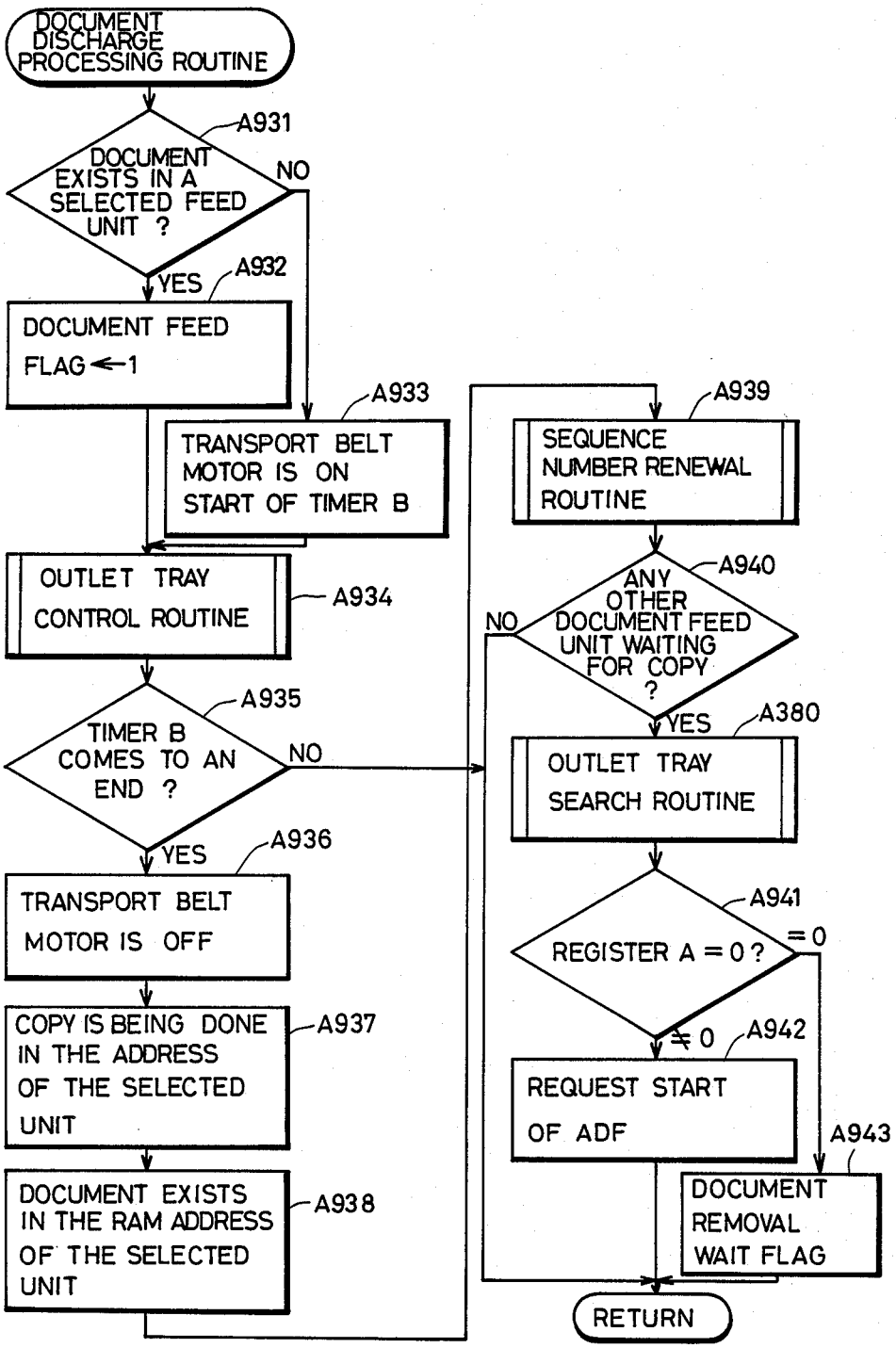

FIG. 24 shows details of a document discharge processing routine for discharging the document from the exposure position. In the first step A931, the CPU 253 determines whether the document remains in the document feed unit selected and subjected to the present copy processing. If the document exists in the unit, the document feed flag is set to 1. If no document exists in the unit, the transport belt motor 305 is turned on to start measurement of a timer B. The timer B serve to control turning off of the transport belt motor 305 for sending the document to the discharge portion. Instead of the timer B, a discharge sensor 307 may be used. Then, the CPU 253 calls the outlet tray control routine (in the step A934) shown in FIG. 26. In this routine, the CPU 253 controls a document path 506 so that the document may be discharged to a preselected document discharge unit. When the document feed flag becomes 1, the document is fed and the transport belt motor 305 is turned on (as shown in FIG. 22). Thus, a new sheet of the document and the copied sheet of the document are transported simultaneously by the transport belt and the copied sheet of the document is subjected to the processing of the outlet tray control routine.

Figure 25:
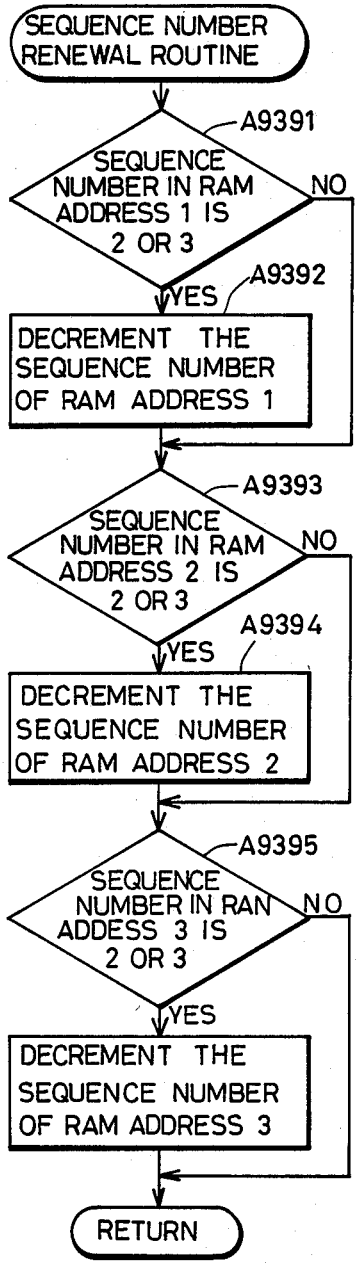

When the timer B completes, in the step A935, measurement of the final exposed sheet of the document, the CPU 253 turns off the transport belt motor and sets, to 0, both the copy operation area and the document area of the RAM address of the selected document feed unit. Then, the CPU 253 calls the sequence number renewal routine in the step A939. In this routine, as shown in FIG. 25, the content of the sequence number area of the RAM address is decremented when the copy processing of all the documents set in one unit is completed, whereby the sequence numbers in the copy order are decremented by one. Since three units are provided in this embodiment, determination of the sequence number is made as to whether it is 2 or 3. If the sequence number is 2, it is changed to 1, and if it is 3, it is changed to 2. In addition, when a new document is set in the unit which becomes empty after the above stated processing, a sequence number 3 is set for the new document according to the routine in FIG. 16.

When the processing in the above stated sequence number renewal routine is completed, the CPU 253 determines in the step A940 whether there are any other document feed units waiting for copy operation. If such a document feed unit exists, the CPU 253 calls the outlet tray search routine shown in FIG. 17 and determines whether an empty document discharge unit exists or not. If an empty document discharge unit exists, that is, if the content of the register A is not 0, the CPU 253 sets the automatic document feeder start request to 1. If an empty document discharge unit does not exist, the CPU 253 sets the document removal wait flag to 1 so that the program returns to the main routine (in the steps A941 to A943).

Figure 26:
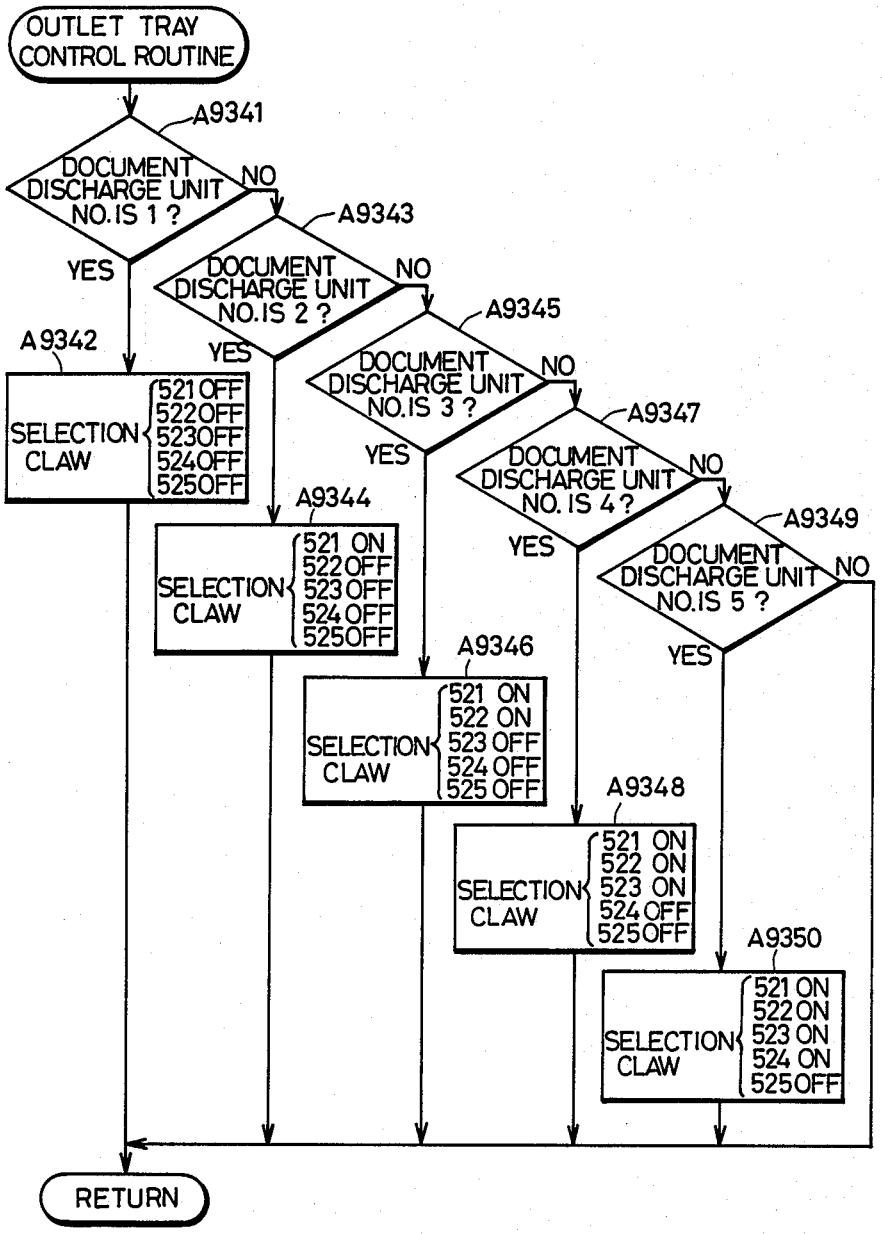

FIG. 26 shows details of an outlet tray control routine. According to the preset number in the discharge unit number area of the RAM map shown in FIG. 7, control is made to turn on and off the electromagnetic solenoid for operating the document outlet path selection claws 521 to 525. For example, if the document which is being fed is discharged to the unit number 5 (in the step A9349), the selection claws 521 to 524 are turned on and the selection claw 525 is turned off (in the step A9350). The document passes smoothly through the transport path 506 upward from the lower end and when the document contacts the selection claw 525, it is led out to the tray 515.

Although the automatic document feeder in the above described embodiment is coupled with three document feed units and five document discharge units, the numbers of those units are not limited thereto. Any number of units may be coupled as far as the support structure permits it.

In addition, if the number of document discharge units is larger than the number of document feed units as in the above described embodiment, there is an advantage that it becomes unnecessary to remove a discharged document each time a sequence of copy processing is completed. Thus, the next copy processing can be started without removing the discharged documents. Further, in view of the possibility that some users will not come to take the discharged documents during a long time, such arrangement of the document feed and discharge units has a large merit.

In addition, although the above described embodiment has a structure in which document feed units are coupled horizontally, a structure for coupling document feed units vertically or obliquely may be adopted. Similarly, a structure for coupling document discharge units horizontally or obliquely may be adopted.

In addition, each of the above described document feed units may be provided with means for displaying a determined sequence number. More specifically, each of the document feed units may comprise a plurality of lamps, a seven-segment display etc. for displaying a sequence number. Further, the sequence number may be displayed by using the numerical value display 610 or 710 of the operation panel of the document feed unit shown in FIG. 5A or 5B. More specifically, when an operator inputs the number of copies, the numerical value display 610 or 710 displays numerical values set by means of the increment key 611 or 711 and the decrement key 612 or 712 and after the set end key 620 or 720 has been operated, the determined sequence number is displayed on the numerical value display 610 or 710.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus having an automatic document feeder, comprising:

a main body, a plurality of document feed means independently provided on said main body in a detachable manner for feeding documents, document transport means provided on said main body for transporting successively said documents fed from said plurality of document feed means to an exposure position and discharging said documents after exposure, copy means provided within said main body for copying the document set at said exposure position, and a plurality of document discharge means independently provided on said main body in a detachable manner for receiving said documents after exposure discharged from said exposure position.

2. A copying apparatus having an automatic document feeder in accordance with claim 1, wherein said plurality of document feed means each comprise:

a document placing table for placing a document to be fed, a document delivery port for delivering the document to be fed, means for transporting the document on said document placing table to said document delivery port, a document receiving port for receiving a document delivered from the document delivery port of another document feed means, and means for transporting the document received by said receiving port to said document delivery port.

3. A copying apparatus having an automatic document feeder in accordance with claim 2, wherein each of said of document feed means comprises connecting means for connecting the adjacent document feed means in a positional relation in which said document delivery port of each of said document feed means is opposed to said document receiving port of said adjacent document feed means.

4. A copying apparatus having an automatic document feeder in accordance with claim 3, wherein said connecting means comprises a connector for bringing said connected document feed means into an electrical relation with said main body of said copying apparatus.

5. A copying apparatus having an automatic document feeder in accordance with claim 1, wherein said plurality of document discharge means each comprise:

a discharged document placing table for placing said discharged document, a discharged document receiving port for receiving said discharged document after exposure, a discharged document sending port for sending the document received by said discharged document receiving port to any one of the other document discharge means, means for transporting the document received by said discharged document receiving port to said discharged document placing table, and means for transporting the document received by said discharge document receiving port to said discharged document sending port.

6. A copying apparatus having an automatic document feeder in accordance with claim 5, wherein each of said document discharge means comprises connecting means for connecting the adjacent document discharge means in a positional relation in which said discharged document receiving port of each of said document discharge means is opposed to said discharged document sending port of said adjacent document discharge means.

7. A copying apparatus having an automatic document feeder in accordance with claim 6, wherein said connecting means comprises a connector for bringing said connected document discharge means into an electrical relation with said main body.

8. A copying apparatus having an automatic document feeder in accordance with claim 7, wherein said plurality of document discharge means are placed one upon another in a vertical direction.

9. A copying apparatus having an automatic document feeder, comprising:

a plurality of document feed means for feeding documents sheet by sheet to an exposure position, each of said plurality of document feed means comprising a document placing table for holding documents, feeding order determining means for automatically determining a document feeding order by detecting the presence of a document on the document placing tables and by allotting a sequence number to each of said document feed means according to the order in which the documents are set on said document placing tables, control means for operating each of said plurality of document feed means according to the order determined by said feeding order determining means, and copy means for copying, at said exposure position, the document fed form each of said plurality of document feed means.

10. A copying apparatus having an automatic document feeder in accordance with claim 9, wherein said control means comprises means for starting feeding of the documents from the document feed means of the subsequent sequence number after having fed all the documents of the document feed means of a sequence number coming earlier.

11. A copying apparatus having an automatic document feeder in accordance with claim 10, further comprising:

document sending means for sending a document after the exposure from said exposure position.

12. A copying apparatus having an automatic document feeder in accordance with claim 11, comprising:

a plurality of document discharge means for receiving the documents sent from said exposure position by said document sending means, each of said plurality of document discharge means having a discharged document placing table for placing any of said documents.

13. A copying apparatus having an automatic document feeder in accordance with claim 12, comprising:

means for discharging a document fed from any of said plurality of document feed means to predetermined one of said plurality of document discharge means.

14. A copying apparatus having an automatic document feeder, comprising:

a plurality of document feed means for feeding documents sheet by sheet to an exposure position, each of said plurality of document feed means comprising a document placing table for holding documents, feeding order determining means for automatically determining a document feeding order by allotting a sequence number to each of said document feed means according to the order in which the documents are set on said document placing tables, control means for operating each of said plurality of document feed means according to the order determined by said feeding order determining means, said control means comprising means for starting feeding of the documents from the document feed means of the subsequent sequence number after having fed all the documents of the document feed means of a sequence number coming earlier, copy means for copying, at said exposure position, the document fed from each of said plurality of document feed means, document sending means for sending a document after the exposure from said exposure position, a plurality of document discharge means for receiving the documents sent from said exposure position by said document sending means, each of said plurality of document discharge means having a discharged document placing table for placing any of said documents, means for discharging a document fed from any of said plurality of document feed means to a predetermined one of said plurality of document discharge means, and each of said document feed means and each of said document discharge means comprising means for coupling said document feed means and said document discharge means respectively to said main body in a detachable manner.

15. A copying apparatus having an automatic document feeder, comprising:

a plurality of document feed means for feeding documents sheet by sheet to an exposure position, each of said plurality of document feed means having a document placing table for holding documents, mode setting means for setting copy conditions for the documents placed on said document placing table of each of said plurality of document feed means, operation order determining means for automatically determining an operation order of said plurality of document feed means by detecting the presence of a document on the document placing tables and by allotting a sequence number to each of said plurality of document feed means according to the order in which the documents are set on said document placing tables, control means for operating each of said document feed means according to said operation order determined by said operation order determining means, and copy means for copying each of the documents fed to said exposure position based on said copy conditions set by said mode setting means.

16. A copying apparatus having an automatic document feeder in accordance with claim 15, wherein said mode setting means comprises copy number setting means for setting the number of copies.

17. A copying apparatus having an automatic document feeder in accordance with claim 15, wherein said mode setting means comprises density setting means for setting a density of copy.

18. A copying apparatus having an automatic document feeder in accordance with claim 15, wherein said mode setting means comprises magnification setting mean for setting a magnification.

19. A copying apparatus having an automatic document feeder in accordance with claim 15, wherein said mode setting means comprises size setting means for setting a size of copy paper.

20. A copying apparatus having an automatic document feeder in accordance with claim 15, further comprising:

a plurality of copy paper storing portions for storing copy paper of different copy paper sizes, copy paper size detecting means for detecting a size of copy paper stored in each of said copy paper storing portions, and document size detecting means for detecting a size of a document to be copied.

21. A copying apparatus having an automatic document feeder in accordance with claim 20, wherein said mode setting means comprises means for setting a mode for estimating the most suitable copy paper size to automatically select copy paper of said copy paper size out of said copy paper storing portions, based on the document size detected by said document size detecting means and the magnification set by said magnification setting means.

22. A copying apparatus having an automatic document feeder in accordance with claim 20, wherein said mode setting means comprises means for setting an automatic magnification selection mode for estimating the most suitable magnification to automatically select said magnification, based on the document size detected by said document size detecting means and the copy paper size detected by said copy paper size detecting means.

23. A copying apparatus having an automatic document feeder, comprising:

a plurality of document feed means for feeding documents sheet by sheet to an exposure position, each of said plurality of document feed means having a document placing table for holding documents, mode setting means for setting copy conditions for the documents placed on said documents placing table of each of said plurality of document feed means, operation order determining means for automatically determining an operation order of said plurality of document feed means by allotting a sequence number to each of said plurality of document feed means according to this order in which the documents are set on said document placing tables, control means for operating each of said document feed means according to said operation order determined by said operation order determining means, copy means for copying each of the documents fed to said exposure position based on said copy conditions set by said mode setting means, and display means for displaying the operation order determined by said operation order determining means.

24. A copying apparatus having an automatic document feeder, comprising:

a plurality of document feed means for feeding documents sheet by sheet to an exposure position, each of said plurality of document feed means having a document placing table for holding documents, mode setting means for setting copy conditions for the documents placed on said document placing table of each of said plurality of document feed means, operation order determining means for determining an operation order of said plurality of document feed means according to the order in which the documents are set on said document placing tables, control means for operating each of said document feed means according to said operation order determined by said operation order determining means, copy means for copying each of the documents fed to said exposure position based on said copy conditions set by said mode setting means, and display means for displaying the operation order determined by said operation order determining means, said display means comprising copy number display means for displaying the number of copies.

25. A copying apparatus having an automatic document feeder, comprising:

a plurality of document feed means for feeding documents sheet by sheet to an exposure position, each of said plurality of document feed means having a document placing table for placing documents, operation order setting means for determining an operation order of said plurality of document feed means by allotting a sequence number to each of said plurality of document feed means, means for operating each of said document feed means according to said order determined by said operation order setting means, and control means for cancelling the sequence number allotted by said operation order setting means to the document feed means from which the document stored therein is removed before it is copied, thereby to set a new operation order by decrementing, by one, the succeeding sequence number or numbers of the remaining document feed means.

26. A copying apparatus having an automatic document feeder in accordance with claim 25, wherein each of said document feed means comprises detecting means for detecting existence of documents on the document placing table thereof.

27. A copying apparatus having an automatic document feeder in accordance with claim 26, wherein said control means comprises means for cancelling said operation order and setting a new operation order based on an output of said detecting means.

28. A copying apparatus having an automatic document feeder, comprising:

copy means for copying a document set at an exposure position, a plurality of document feed means for feeding documents sheet by sheet to said exposure position, each of said plurality of document feed means having a document placing table for holding documents, document sending means for setting the document fed by said document feed means at said exposure position and sending the document after the exposure from said exposure position, a plurality of document discharge means, each being constructed to contain documents, for receiving the documents sent by said document sending means from said exposure position, each of said document discharge means is given a predetermined order of priority, detecting means for making detection as to whether said plurality of document discharge means contain documents, designating means for designating any one of the document discharge means having a first priority out of the document discharge means which contains no document, and control means for enabling the document discharge means designated by said designating means to receive the document fed from any of said document feed means.

29. A copying apparatus having an automatic document feeder in accordance with claim 28, wherein said order of priority is determined according to the order of facility for an operator to remove documents from said plurality of document discharge means.

30. A copying apparatus having an automatic document feeder, comprising:

copy means for copying a document set at an exposure position;

document feed means for feeding documents sheet by sheet to said exposure position, said document feed means having a document placing table for placing documents, document sending means for setting the document fed by said document feed means at said exposure position and sending the document after the exposure from said exposure position, document discharge means, for receiving the documents sent by said document sending means from said exposure position, means for detecting copied documents in said document discharge means, instruction input means for inputting an instruction for starting a sequence of copy operation for the documents contained in said document feed means, and forbidding means for forbidding the start of copy operation by said instruction input means when said detecting means detects the copied documents in said document discharge means.

31. A copying apparatus having an automatic document feeder in accordance with claim 30, comprising:

forbidding cancel means for cancelling said forbidding when said copied document contained in said document discharge means is removed.

32. A copying apparatus having an automatic document feeder in accordance with claim 31, wherein said forbidding cancel means comprises means for starting a sequence of copy operation automatically by said copy means in response to the cancellation of said forbidding.

33. A copying apparatus having an automatic document feeder, comprising:

copy means for Copying a document set at an exposure position, a plurality of document feed means for feeding documents sheet by sheet to said exposure position, each of said plurality of document feed means having a document placing table for placing documents, documents sending means for setting the document fed by said document feed means at said exposure position and sending the document after the exposure from said exposure position, a plurality of document discharge means, each being constructed to contain documents, for receiving the documents sent by said document sending means from said exposure position, means for discriminating the document discharge means which contain no copied document from the remaining document discharge means which contain the copied document, setting means for setting an operation order of said plurality of document feed means by allotting a sequence number to each of said plurality of document feed means, means for performing a sequence of copy operation by driving said plurality of document feed means according to the operation order set by said setting means, thereby to cause one of said document discharge means which contain not document to receive the documents fed from one of said document feed means, and interrupting means for interrupting, when all of said plurality of document discharge means contain documents, copy operation of the document from the document feed means of the subsequent sequence number after the document of the document feed means operated at present has been copied.

34. A copying apparatus having an automatic document feeder in accordance with claim 33, comprising:

means for starting copy operation cf the document from the document feed means of the subsequent sequence number when the document contained in said plurality of document discharge means is removed from at least one of said plurality of document discharge means.

35. A copying apparatus having an automatic document feeder, comprising:

a plurality of document feed means for feeding documents sheet by sheet to an exposure position, each of said plurality of document feed means having a document placing table for holding documents, mode setting means for setting copy conditions for the documents placed on said document placing table of each of said plurality of document feed means, operation order determining means for determining an operation order of said plurality of document feed means by allotting a sequence number to each of said plurality of document feed means according to the order in which copy conditions have been set by said mode setting means, display means for displaying the operation order determined by said operation order determining means, control means for operating each of said document feed means accordance to said operation order determined by said operation order determining means, and copy means for copying each of the documents fed to said exposure position based on said copy conditions set by said mode setting means.

36. A copying apparatus having an automatic document feeder in accordance with claim 35, wherein said display means comprises copy number display means for displaying the number of copies

37. A copying apparatus having an automatic document feeder, comprising:

a plurality of document feed means for feeding documents sheet by sheet to an exposure position, each of said plurality of document feed means comprising a document placing table for holding documents, feeding order determining means for determining a document feeding order by allotting a sequence number to each of said document feed means according to the order in which the documents are set on said document placing tables, said feeding order determining means comprising sensing means associated with said document placing tables for sensing the presence of a document sheet on the document placing table so that in response to the sensing of a document sheet by the sensing means, a sequence number is allotted to the document feed means, control means for operating each of said plurality of document feed means according to the order determined by said feeding order determining means, and copy means for copying at said exposure position, the document fed from each of said plurality of document feed means.

38. A copying apparatus having an automatic document feeder, comprising:

a plurality of document feed means for feeding documents sheet by sheet to an exposure position, each of said plurality of document feed means having a document placing table for holding documents, mode setting means for setting copy conditions for the documents placed on said document table of each of said plurality of document feed means, operation order determining means for determining an operation order of said plurality of document feed means by allotting a sequence number to each of said plurality of document feed means according to the order in which the documents are set on said document placing tables, said operation order determining means comprising sensing means associated with said document placing tables for sensing the presence of a document sheet on the document placing table so that in response to the sensing of a document sheet by the sensing means, a sequence number is allotted to the document feed means, control means for operation each of said document feed means according to said operation order determined by said operation order determining means, and copy means for copying each of the documents fed to said exposure position based on said copy conditions set by said mode setting means.

* * * * *